US009903235B2

(12) United States Patent
Mukaide et al.

(10) Patent No.: US 9,903,235 B2
(45) Date of Patent: Feb. 27, 2018

(54) VALVE TIMING CONTROL APPARATUS

(71) Applicant: AISIN SEIKI KABUSHIKI KAISHA, Kariya-shi, Aichi-ken (JP)

(72) Inventors: Hiroki Mukaide, Chiryu (JP); Naoto Toma, Kariya (JP); Yoshiaki Yamakawa, Toyota (JP); Masaki Kobayashi, Okazaki (JP); Takeshi Hayashi, Nagoya (JP); Hiroyuki Amano, Kariya (JP)

(73) Assignee: AISIN SEIKO KABUSHIKI KAISHA, Kariya-Shi, Aichi-Ken (JP)

( * ) Notice: Subject to any disclaimer, the term of this patent is extended or adjusted under 35 U.S.C. 154(b) by 155 days.

(21) Appl. No.: 14/834,568

(22) Filed: Aug. 25, 2015

(65) Prior Publication Data

US 2016/0061064 A1 Mar. 3, 2016

(30) Foreign Application Priority Data

Aug. 29, 2014 (JP) ..... 2014-175497
Feb. 18, 2015 (JP) ..... 2015-030006

(51) Int. Cl.
*F01L 1/344* (2006.01)
*F01L 1/24* (2006.01)

(52) U.S. Cl.
CPC ..... *F01L 1/344* (2013.01); *F01L 1/24* (2013.01); *F01L 1/3442* (2013.01);
(Continued)

(58) Field of Classification Search
CPC ..... F01L 2001/34423; F01L 2001/3443; F01L 2001/34463; F01L 2001/34483
(Continued)

(56) References Cited

U.S. PATENT DOCUMENTS 6,505,586 B1 * 1/2003 Sato ..... F02D 13/0238 123/90.15
6,684,835 B2 2/2004 Komazawa et al.
(Continued)

FOREIGN PATENT DOCUMENTS

JP 2003-172109 A 6/2003
JP 2011-256772 A 12/2011
(Continued)

OTHER PUBLICATIONS

European Search Report dated Mar. 23, 2016, by the European Patent Office, in corresponding European Patent Application No. 15179843.6 (8 pages).

*Primary Examiner* — Jorge Leon, Jr.
(74) *Attorney, Agent, or Firm* — Buchanan Ingersoll & Rooney PC

(57) ABSTRACT

A valve timing control apparatus includes: a drive-side rotational member synchronously rotating with a drive shaft of an internal combustion engine; a driven-side rotational member disposed inside the drive-side rotational member and integrally rotating with a valve opening/closing camshaft; a hydrostatic pressure chamber formed by partitioning a space between the drive-side rotational and driven-side rotational members; an advance angle chamber and a retardation angle chamber formed by dividing the hydrostatic pressure chamber; an intermediate lock mechanism able to selectively switch between locked and unlocked states; an advance angle flow path allowing the hydraulic fluid to be circulated; a retardation angle flow path allowing the hydraulic fluid to be circulated; a control valve having a spool; and a phase control unit controlling the control valve.

9 Claims, 28 Drawing Sheets

(52) U.S. Cl.
CPC ..... *F01L 2001/3443* (2013.01); *F01L 2001/34433* (2013.01); *F01L 2001/34446* (2013.01); *F01L 2001/34463* (2013.01); *F01L 2001/34473* (2013.01); *F01L 2001/34476* (2013.01); *F01L 2001/34479* (2013.01); *F01L 2001/34483* (2013.01); *F01L 2250/02* (2013.01); *F01L 2800/01* (2013.01)

(58) Field of Classification Search
USPC ..... 123/90.12, 90.17
See application file for complete search history.

(56) References Cited

U.S. PATENT DOCUMENTS 8,915,222 B2 12/2014 Kobayashi et al.
2007/0017463 A1* 1/2007 Mott ..... F01L 1/34409 123/90.17
2007/0144475 A1* 6/2007 Suzuki ..... F01L 1/022 123/90.17
2009/0288625 A1* 11/2009 Toma ..... F01L 1/3442 123/90.17
2011/0017156 A1 1/2011 Smith
2012/0017859 A1* 1/2012 Numakura ..... F01L 1/3442 123/90.17
2013/0068183 A1* 3/2013 Takada ..... F01L 1/3442 123/90.17
2013/0146005 A1* 6/2013 Watanabe ..... F01L 1/3442 123/90.15
2013/0180486 A1* 7/2013 Smith ..... F01L 1/3442 123/90.17
2013/0213326 A1* 8/2013 Fujimura ..... F01L 1/34 123/90.12
2013/0233261 A1* 9/2013 Watanabe ..... F01L 1/3442 123/90.15
2014/0083379 A1* 3/2014 Yoshimura ..... F01L 1/3442 123/90.15
2015/0090207 A1* 4/2015 Lichti ..... F01L 1/344 123/90.17

FOREIGN PATENT DOCUMENTS

JP 2013-100836 A 5/2013
JP 2015-124620 A 7/2015
WO 2009/114500 A1 9/2009

* cited by examiner

| | PA1 | PA2 | PL | PB2 | PB1 |
|---|---|---|---|---|---|
| ADVANCE ANGLE CHAMBER | SUPPLY | SUPPLY | BLOCK | DISCHARGE | DISCHARGE /SUPPLY |
| RETARDATION ANGLE CHAMBER | DISCHARGE | DISCHARGE | BLOCK | SUPPLY | SUPPLY |
| LOCK MEMBER | DISCHARGE | SUPPLY | SUPPLY | SUPPLY | DISCHARGE |

| | PA1 | PA2 | PL | PB2 | PB1 | |
|---|---|---|---|---|---|---|
| | | | | | ② | ① |
| ADVANCE ANGLE CHAMBER | SUPPLY | SUPPLY | BLOCK | DISCHARGE | DISCHARGE | DISCHARGE /SUPPLY |
| RETARDATION ANGLE CHAMBER | DISCHARGE | DISCHARGE | BLOCK | SUPPLY | SUPPLY | SUPPLY |
| LOCK MEMBER | DISCHARGE | SUPPLY | SUPPLY | SUPPLY | DISCHARGE | DISCHARGE |

FIG.21

| | PA1 | PA1a | PA2 | PL | PB2 |
|---|---|---|---|---|---|
| ADVANCE ANGLE CHAMBER | SUPPLY | | SUPPLY | BLOCK | DISCHARGE |
| RETARDATION ANGLE CHAMBER | SUPPLY | | DISCHARGE | BLOCK | SUPPLY |
| RECESSED INTERMEDIATE LOCK SECTION | DISCHARGE | SUPPLY | SUPPLY | SUPPLY | SUPPLY |

FIG.22

| | PA2 | PL | PB2 | PB1a | PB1 |
|---|---|---|---|---|---|
| ADVANCE ANGLE CHAMBER | SUPPLY | BLOCK | DISCHARGE | SUPPLY | |
| RETARDATION ANGLE CHAMBER | DISCHARGE | BLOCK | SUPPLY | SUPPLY | |
| RECESSED INTERMEDIATE LOCK SECTION | SUPPLY | SUPPLY | SUPPLY | SUPPLY | DISCHARGE |

FIG.23

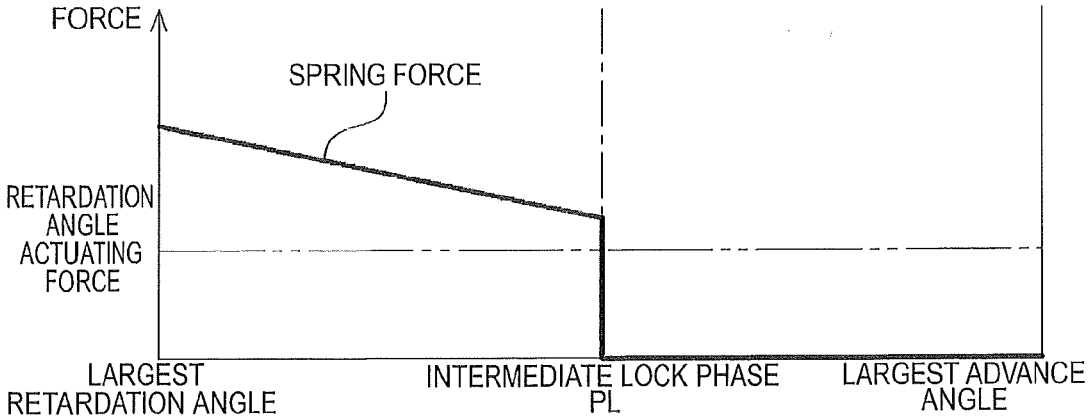

FIG.35

| | PB1 | PB2 | PL | PA2 | PA1 | PA0 |
|---|---|---|---|---|---|---|
| ADVANCE ANGLE CHAMBER | DISCHARGE | DISCHARGE | BLOCK | SUPPLY | SUPPLY | SUPPLY |
| RETARDATION ANGLE CHAMBER | SUPPLY | SUPPLY | BLOCK | DISCHARGE | DISCHARGE | SUPPLY |
| RECESSED INTERMEDIATE LOCK SECTION | DISCHARGE | SUPPLY | SUPPLY | SUPPLY | DISCHARGE | |

FIG.36

| | PA1 | PA2 | PL | PB2 | PB0 |
|---|---|---|---|---|---|
| ADVANCE ANGLE CHAMBER | SUPPLY | SUPPLY | BLOCK | DISCHARGE | DISCHARGE |
| RETARDATION ANGLE CHAMBER | SUPPLY | DISCHARGE | BLOCK | SUPPLY | SUPPLY |
| RECESSED INTERMEDIATE LOCK SECTION | DISCHARGE / SUPPLY | SUPPLY | SUPPLY | SUPPLY | DISCHARGE |

FIG.37

| | PA1 | PA2 | PL | PB2 | PB1 |
|---|---|---|---|---|---|
| ADVANCE ANGLE CHAMBER | SUPPLY | SUPPLY | BLOCK | DISCHARGE | SUPPLY |
| RETARDATION ANGLE CHAMBER | DISCHARGE | DISCHARGE | BLOCK | SUPPLY | SUPPLY |
| RECESSED INTERMEDIATE LOCK SECTION | DISCHARGE | SUPPLY | SUPPLY | SUPPLY | SUPPLY / DISCHARGE |

VALVE TIMING CONTROL APPARATUS

CROSS REFERENCE TO RELATED APPLICATIONS

This application is based on and claims priority under 35 U.S.C. § 119 to Japanese Patent Applications 2014-175497 and 2015-030006, filed on Aug. 29, 2014 and Feb. 18, 2015, respectively, the entire contents of which are incorporated herein by reference.

TECHNICAL FIELD

This disclosure relates to a valve timing control apparatus that controls a relative rotational phase between a drive-side rotational member which is synchronized and rotates with a crankshaft of an internal combustion engine and a driven-side rotational member which integrally rotates with a camshaft.

BACKGROUND DISCUSSION

In recent years, a valve timing control apparatus that changes opening/closing timings of an intake valve and an exhaust valve in accordance with a driving condition of an internal combustion engine (hereinafter, referred to as an "engine"). The valve timing control apparatus has a configuration in which a relative rotational phase between a drive-side rotational member which is driven by a crankshaft and a driven-side rotational member which integrally rotates with a camshaft (hereinafter, simply referred to as a "relative rotational phase") are changed such that the opening/closing timings of the intake and exhaust valves which are opened and closed in response to the rotation of the driven-side rotational member are changed.

In general, the optimum opening/closing timings of the intake and exhaust valves vary depending on the driving condition of the engine such as starting of the engine or traveling of a vehicle. At the starting of the engine, the relative rotational phase is restricted to an intermediate lock phase between the largest retardation angle phase and the largest advance angle phase such that the opening/closing timings of the intake and exhaust valves are set to have the optimum state for the starting of the engine.

JP 2013-100836 (Reference 1) discloses a valve timing control apparatus having an intermediate lock mechanism, in which opening/closing timings are restricted to an intermediate lock phase during stopping of an engine. Since both an advance angle chamber and a retardation angle chamber need to be promptly filled with oil after the engine is started, the advance angle chamber and the retardation angle chamber communicate with each other in a locked state such that the oil supplied to the advance angle chamber is also supplied to the retardation angle chamber through a communication path. At this time, an oil supply path of the retardation angle chamber is opened to a drain and air in a hydrostatic pressure chamber, which hinders the filling of the oil, is discharged such that the filling of the oil is enhanced.

However, in the valve timing control apparatus disclosed in Reference 1, since, when the engine is stopped, the advance angle chamber and the retardation angle chamber communicate with each other and one of the advance angle chamber and the retardation angle chamber communicates with the drain, oil in the hydrostatic pressure chamber is likely to be discharged. Therefore, when the engine is started, little amount of oil remains in the hydrostatic pressure chamber and it takes time to fill the hydrostatic pressure chamber with oil in this state. In addition, when the engine is abnormally stopped such as during a stall of the engine, it is difficult to set at a lock phase in some cases. If a sufficient amount of oil is not supplied to the hydrostatic pressure chamber, a driven-side rotational member that is likely to receive cam swinging torque is greatly oscillated with respect to a drive-side rotational member and, not only it is not possible for the engine to be started but there is also a concern that, since a vane section repeatedly comes into contact with a partition section inside the apparatus, noise will be produced or the drive-side rotational member will be deformed.

SUMMARY

Thus, a need exists for a valve timing control apparatus which is not suspectable to the drawback mentioned above.

An aspect of this disclosure is directed to a valve timing control apparatus including: a drive-side rotational member that synchronously rotates with a drive shaft of an internal combustion engine; a driven-side rotational member that is disposed inside the drive-side rotational member to be coaxial to the drive-side rotational member and that integrally rotates with a valve opening/closing camshaft of the internal combustion engine; a hydrostatic pressure chamber that is formed by partitioning a space between the drive-side rotational member and the driven-side rotational member; an advance angle chamber and a retardation angle chamber that are formed by dividing the hydrostatic pressure chamber with a dividing section provided on at least one of the drive-side rotational member and the driven-side rotational member; an intermediate lock mechanism that is able to selectively switch, through supplying and discharging of a hydraulic fluid, between a locked state in which a relative rotational phase of the driven-side rotational member to the drive-side rotational member is restricted to an intermediate lock phase between the largest advance angle phase and the largest retardation angle phase and an unlocked state in which the restriction to the intermediate lock phase is released; an advance angle flow path that allows the hydraulic fluid which is supplied to and discharged from the advance angle chamber to be circulated; a retardation angle flow path that allows the hydraulic fluid which is supplied to and discharged from the retardation angle chamber to be circulated; a control valve that has a spool which moves between a first position in a case where a power supply amount is zero and a second position different from the first position in a case of power supply; and a phase control unit that controls the control valve by controlling a power supply amount to the control valve and that supplies a hydraulic fluid to the advance angle chamber and the retardation angle chamber to shift the relative rotational phase. When the spool is disposed at one of the first position and the second position, the hydraulic fluid is set to be supplied to both the advance angle chamber and the retardation angle chamber.

BRIEF DESCRIPTION OF THE DRAWINGS

The foregoing and additional features and characteristics of this disclosure will become more apparent from the following detailed description considered with the reference to the accompanying drawings, wherein:

FIG. 21 is a diagram showing a relationship between supply and discharge of the control valve;

FIG. 22 is a diagram showing a relationship between supply and discharge of a control valve according to a modification example;

FIG. 23 is a graph showing a relationship between a relative rotational phase and a spring force;

FIG. 35 is a diagram showing a relationship between supply and discharge of the control valve;

FIG. 36 is a diagram showing a relationship between supply and discharge of a control valve according to another embodiment (a); and FIG. 37 is a diagram showing a relationship between supply and discharge of a control valve according to still another embodiment (b).

DETAILED DESCRIPTION

Hereinafter, embodiments disclosed here will be described based on the drawings.

First Embodiment

Hereinafter, a first embodiment that is achieved by applying this disclosure to a valve timing control apparatus on a side of an intake valve in an automobile engine (hereinafter, simply referred to as an "engine") will be described in detail based on the drawings. In the following description of the embodiments, an engine E is an example of an internal combustion engine.

Entire Configuration

Figure 1:
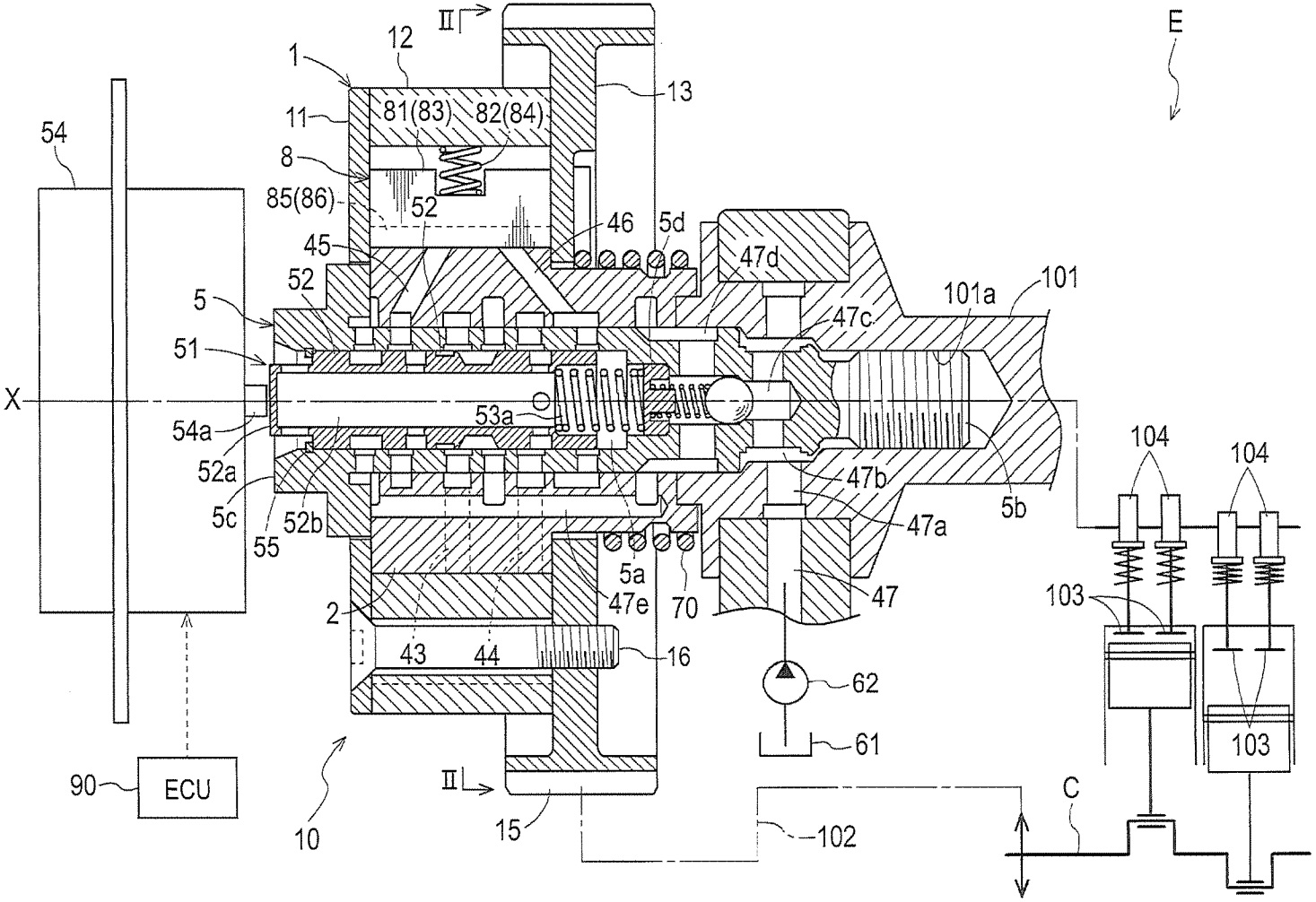
FIG. 1 is a longitudinal sectional diagram showing a configuration of a valve timing control apparatus according to a first embodiment.

As shown in FIG. 1, a valve timing control apparatus 10 includes a housing 1 that synchronously rotates with a crankshaft C and an inner rotor 2 that is disposed on the inner side of the housing 1 to be coaxial to a shaft core X of the housing 1 and integrally rotates with a valve opening/closing camshaft 101 of the engine E. The camshaft 101 means a rotating shaft of a cam 104 which controls opening and closing of an intake valve 103 of the engine E and synchronously rotates with the inner rotor 2 and a fixing bolt 5. The camshaft 101 is rotatably assembled into a cylinder head of the engine E. The crankshaft C is an example of a drive shaft, the housing 1 is an example of a drive-side rotational member, and the inner rotor 2 is an example of a driven-side rotational member.

An external thread 5*b* is formed at an end portion of the fixing bolt 5 on a side close to the camshaft 101. The fixing bolt 5 is inserted at the center in a set-up state of the housing 1 and the inner rotor 2 and the external thread 5*b* of the fixing bolt 5 and an internal thread 101*a* of the camshaft 101 are screwed together. In this manner, the fixing bolt 5 is fixed to the camshaft 101 and the inner rotor 2 and the camshaft 101 are also fixed.

The housing 1 is configured through assembling, using a fastening bolt 16, a front plate 11 which is disposed on a side opposite to a side on which the camshaft 101 is connected, an outer rotor 12 which is disposed over the external side of the inner rotor 2, and a rear plate 13 which is integrally provided with a timing sprocket 15 and is disposed on the side on which the camshaft 101 is connected. The inner rotor 2 is accommodated in the housing 1 and a hydrostatic pressure chamber 4 to be described below is formed between the inner rotor 2 and the outer rotor 12. The inner rotor 2 and the outer rotor 12 are configured to be relatively rotatable about the shaft core X. The timing sprocket 15 may not be provided on the rear plate 13 but may be provided on an outer peripheral section of the outer rotor 12.

A torsion spring 70 disposed between the housing 1 and the camshaft 101 causes a bias force to be applied in a rotating direction S about the shaft core X and functions as a phase setting mechanism. The torsion spring 70 causes the bias force to be applied over the entire region of a relative rotational phase of the inner rotor 2 with respect to the housing 1 (hereinafter, simply referred to as the "relative rotational phase"). The torsion spring 70 may be configured to cause the bias force to be applied, for example, in a state in which the relative rotational phase is at the largest retardation angle to a state in which the relative rotational phase reaches a predetermined relative rotational phase on an advance angle side (intermediate lock phase P to be described below according to the present embodiment) and to cause the bias force not to be applied to a region in which the relative rotational phase is further on an advance angle side than the predetermined rotational phase. The torsion spring 70 may be disposed between the housing 1 and the inner rotor 2.

Figure 2:
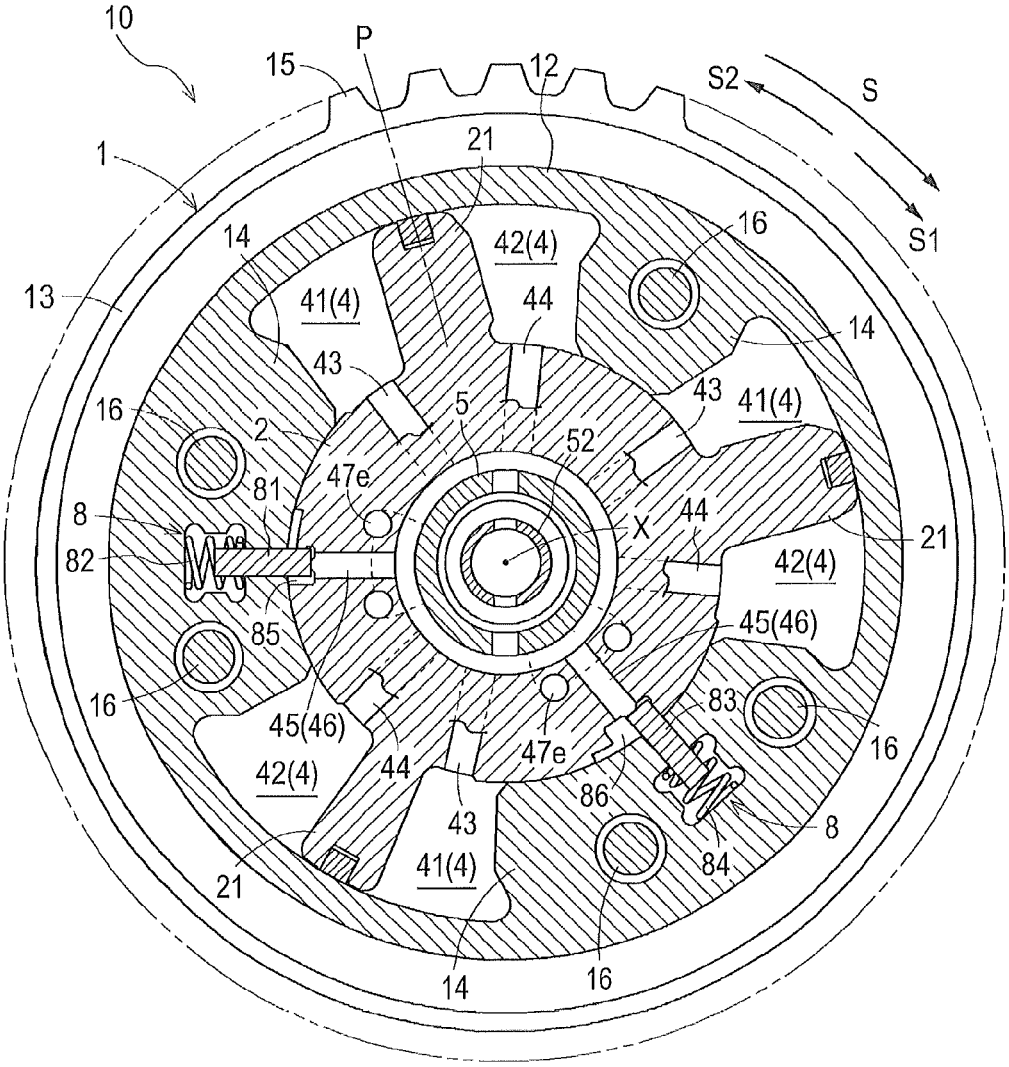
FIG. 2 is a sectional diagram taken along line II-II in FIG. 1.

When the crankshaft C rotates, a rotational drive force thereof is transmitted to the timing sprocket 15 through a power transmitting member 102 and the housing 1 is driven to rotate in the rotating direction S shown in FIG. 2. In response to the rotational drive of the housing 1, the inner rotor 2 is rotatably driven in the rotating direction S such that the camshaft 101 rotates and the cam 104 provided on the camshaft 101 presses down the intake valve 103 of the engine E and the valve is opened.

As shown in FIG. 2, three protrusions 14 which protrude toward the inner side in a radial direction are formed in the outer rotor 12 and three vanes 21 are formed on the outer circumferential surface of the inner rotor 2. In this manner, the hydrostatic pressure chamber 4 is formed between the inner rotor 2 and the outer rotor 12 and an advance angle chamber 41 and a retardation angle chamber 42 are formed.

Hydraulic oil as a hydraulic fluid is supplied to and discharged from the advance angle chamber 41 and the retardation angle chamber 42 or the supplying and discharging are blocked. In this manner, the oil pressure of the hydraulic oil acts on the vane 21 and the relative rotational phase is shifted in an advance angle direction or a retardation angle direction due to the oil pressure thereof, or an arbitrary phase is maintained. The advance angle direction means a direction in which the volume of the advance angle chamber 41 becomes greater and is a direction represented by arrow S1 in FIG. 2. The retardation angle direction means a direction in which the volume of the retardation angle chamber 42 becomes greater and is a direction represented by arrow S2 in FIG. 2.

As shown in FIG. 2, in the inner rotor 2, an advance angle flow path 43 that communicates with the advance angle chamber 41, a retardation angle flow path 44 that communicates with the retardation angle chamber 42, an unlock flow path 45 through which hydraulic oil that is supplied to and discharged from an intermediate lock mechanism 8 to be described below is circulated, and a locking discharge flow path 46 are formed. The hydraulic oil is stored in an oil pan 61 and is supplied to each component by using an oil pump 62.

Intermediate Lock Mechanism

The valve timing control apparatus 10 includes the intermediate lock mechanism 8 that restricts a shift of the relative rotational phase of the inner rotor 2 to the housing 1 and thereby restricts the relative rotational phase to the intermediate lock phase P between the largest advance angle phase and the largest retardation angle phase. The engine E is started in a state in which the relative rotational phase is restricted to the intermediate lock phase P. In this manner, even in a circumstance in which the oil pressure of the hydraulic oil is not stable immediately after the engine start, it is possible to appropriately maintain a rotational phase of the camshaft 101 with respect to a rotational phase of the crankshaft C and to realize stable rotation of the engine E.

As shown in FIG. 2, the intermediate lock mechanism 8 is configured to include a first lock member 81, a first spring 82 as a bias mechanism, a second lock member 83, a second spring 84 as the bias mechanism, a first recessed portion 85 as an engagement portion, and a second recessed portion 86 as the engagement portion. The intermediate lock mechanism 8 may be configured to include the first lock member 81 and the first spring 82.

The first lock member 81 moves toward the inner rotor 2 due to a bias force of the first spring 82 and the second lock member 83 moves toward the inner rotor 2 due to a bias force of the second spring 84. The first recessed portion 85 and the second recessed portion 86 are formed into a step shape such that the intermediate lock phase P is easily performed.

The unlock flow path 45 and the locking discharge flow path 46 are provided on the bottom of the first recessed portion 85 and the second recessed portion 86. The unlock flow path 45 allows hydraulic oil that is supplied to and discharged from the first recessed portion 85 and the second recessed portion 86 to be circulated. Meanwhile, the locking discharge flow path 46 does not allow hydraulic oil that is supplied to the first recessed portion 85 and the second recessed portion 86 to be circulated, but allows hydraulic oil that is discharged from the first recessed portion 85 and the second recessed portion 86 to the outside of the valve timing control apparatus 10 to be circulated.

As shown in FIG. 1, FIG. 2, and FIG. 4 to FIG. 8, the locking discharge flow path 46 that is connected to the first recessed portion 85 and the second recessed portion 86 is configured to include a first discharge section **46*a* formed on the fixing bolt 5, and a second discharge section 46*b* formed on the inner rotor 2, which is connected to the first discharge section 46*a*. The first discharge section 46*a* is connected to a sixth annular groove 47*m* formed on an inner circumferential surface of the fixing bolt 5, which faces an accommodation space 5*a***.

OCV

As shown in FIG. 1, according to the present embodiment, an oil control valve (OCV) 51 as a control valve is disposed on the inner side of the inner rotor 2 to be coaxial to the shaft core X. The OCV 51 is an example of a control valve. The OCV 51 is configured to include a spool 52, a first valve spring **53*a* that biases the spool 52, and an electromagnetic solenoid 54 that drives the spool 52 through changing a power supply amount. The OCV 51 causes a position of the spool 52 to be changed through changing the power supply amount to the electromagnetic solenoid 54, performs control of supplying the hydraulic oil to the retardation angle chamber 42 and discharging the hydraulic oil from the advance angle chamber 41 or control of supplying the hydraulic oil to the advance angle chamber 41 and discharging the hydraulic oil from the retardation angle chamber 42, and performs control of supplying and discharging the hydraulic oil to and from the intermediate lock mechanism 8 such that the relative rotational phase is shifted. A detailed description of the electromagnetic solenoid 54** is omitted because the known technology is applied thereto.

The spool 52 is configured to be accommodated in the accommodation space 5*a* that is a circular hole in a sectional view, which is formed parallel to a direction of the shaft core X from a head portion 5*c* that is an end portion of the fixing bolt 5 on a side apart from the camshaft 101 and to be slidable in the inside of the accommodation space 5*a* in the direction of the shaft core X. The spool 52 has a main discharge flow path 52*b* that is a circular bottomed hole in a sectional view, which is formed parallel to the direction of the shaft core X. The main discharge flow path 52*b* has a uniform inner diameter and is formed to have a step portion in the vicinity of an entrance. The main discharge flow path 52*b* may have an inner diameter that is equally increased to that on the discharge side thereof.

The first valve spring 53*a* is disposed deep inside the accommodation space 5*a* and continuously biases the spool 52 toward (in a leftward direction in FIG. 1) the electromagnetic solenoid 54. A stopper 55 attached to the accommodation space 5*a* prevents the spool 52 from slipping out from the accommodation space 5*a*. One side of the first valve spring 53*a* is held in the step portion formed in the main discharge flow path 52*b*. A partition 5*d* is inserted in a boundary between the accommodation space 5*a* and a third supply section 47*c* which is a bottomed hole having a small inner diameter, which is formed to be connected to the accommodation space 5*a* and thus, the partition 5*d* holds the other side of the first valve spring 53*a*. When power is supplied to the electromagnetic solenoid 54, a push pin 54*a* provided on the electromagnetic solenoid 54 presses an end portion 52*a* of the spool 52. As a result, the spool 52 slides toward the camshaft 101 against the bias force of the first valve spring 53*a*. The OCV 51 is configured to adjust a position of the spool 52 by changing the power supply amount to the electromagnetic solenoid 54 from zero to the maximum value. The power supply amount to the electromagnetic solenoid 54 is controlled by an electronic control unit (ECU) 90 (an example of a phase control unit). That is, the ECU 90 changes the power supply amount to the OCV 51 to control an operation of the OCV 51.

The OCV 51 switches between supplying, discharging, and holding the hydraulic oil to and from, in the advance angle chamber 41 and the retardation angle chamber 42 depending on a position of the spool 52 and switches between supplying and discharging the hydraulic oil to and from the intermediate lock mechanism 8.

Configuration of Oil Path

As shown in FIG. 1, the hydraulic oil stored in the oil pan 61 is sucked up by a mechanical oil pump 62 that drives by transmitting a rotational driving force of the crankshaft C and is circulated through a supply flow path 47 to be described below. The hydraulic oil circulated through the supply flow path 47 is supplied to the advance angle flow path 43, the retardation angle flow path 44, and the unlock flow path 45, through the OCV 51.

As shown in FIG. 1 and FIG. 4 to FIG. 8, the advance angle flow path 43 that is connected to the advance angle chamber 41 is configured to include a first advance angle section 43*a* which is a through-hole formed in the fixing bolt 5, and a second advance angle section 43*b* formed in the inner rotor 2 to be connected to the first advance angle section 43*a*. The retardation angle flow path 44 that is connected to the retardation angle chamber 42 is configured to include a first retardation angle section 44*a* which is a through-hole formed in the fixing bolt 5, and a second retardation angle section 44*b* formed in the inner rotor 2 to be connected to the first retardation angle section 44*a*. The unlock flow path 45 that is connected to the first recessed portion 85 and the second recessed portion 86 is configured to include a first unlock section 45*a* which is a through-hole formed in the fixing bolt 5, and a second unlock section 45*b* formed in the inner rotor 2 to be connected to the first unlock section 45*a*.

The supply flow path 47 is configured to include a first supply section 47*a* formed in the camshaft 101, a second supply section 47*b* which is a space between the camshaft 101 and the fixing bolt 5, a third supply section 47*c* formed in the fixing bolt 5, a fourth supply section 47*d* formed around the fixing bolt 5, a fifth supply section 47*e* formed in the inner rotor 2, and two sixth supply sections 47*f* formed at different positions in the direction of the shaft core X of the fixing bolt 5 and the sections are connected to each other in this order.

The third supply section 47*c* is configured to have a bottomed hole formed in the fixing bolt 5 in the direction of the shaft core X and a plurality of holes which penetrate therethrough at two different places in the direction of the shaft core X to the outer circumference thereof. A check valve 48 is provided at an intermediate position of the bottomed hole, and a second valve spring 53*b* which is held by the partition 5*d* and the check valve 48 is biased in a direction in which the bottomed hole of the third supply section 47*c* is closed.

The fifth supply section 47*e* is configured to include a flow path which is formed in the inner rotor 2 in the direction of the shaft core X and which is closed at both ends, and three annular grooves formed at three different places in the direction of the shaft core X from the flow path to an inner circumferential surface toward the inner side in the radial direction. One of the three annular grooves faces the fourth supply section 47*d* and the remaining two annular grooves face the sixth supply sections 47*f*, respectively.

Figures 3, 4:
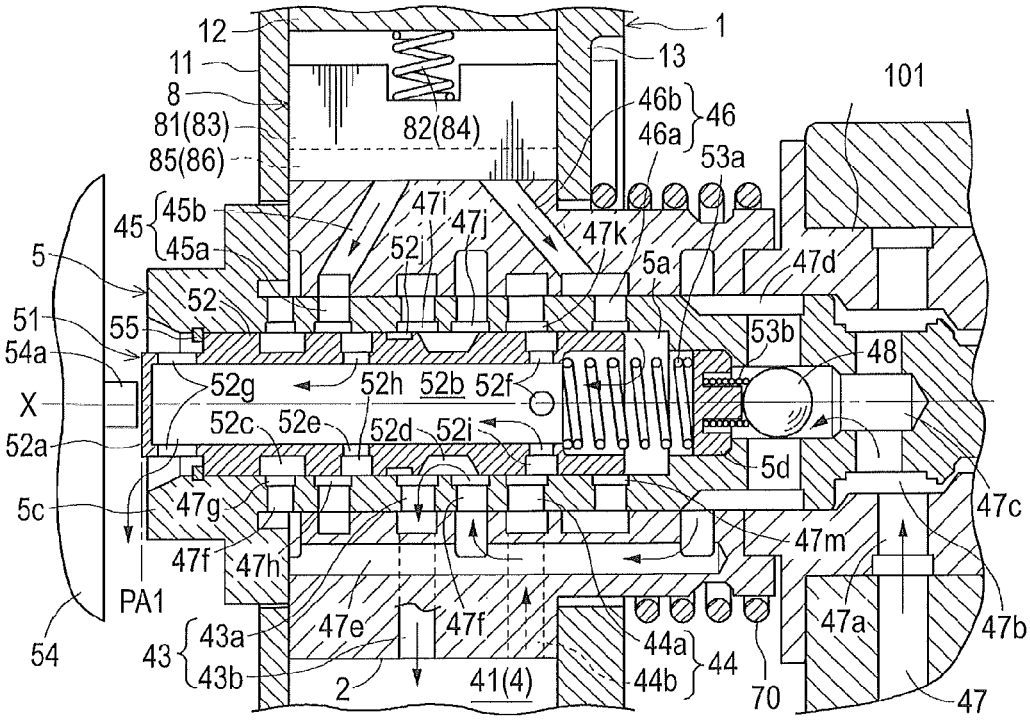
FIG. 3 shows a position of an OCV and a supply and discharge pattern of hydraulic oil.
FIG. 4 is an enlarged sectional diagram showing an operation state of the OCV in PA1.

As shown in order from left to right in FIG. 4, the sixth supply section 47*f*, the first unlock section 45*a*, the first advance angle section 43*a*, the sixth supply section 47*f*, and the first retardation angle section 44*a*, which are through-holes formed in the fixing bolt 5, are connected to a first annular groove 47*g*, a second annular groove 47*h*, a third annular groove 47*i*, a fourth annular groove 47*j*, and a fifth annular groove 47*k*, respectively, which are annular grooves formed on the inner circumferential surface of the fixing bolt 5 which faces the accommodation space 5*a*.

A seventh annular groove 52*c* and an eighth annular groove 52*d* are formed on an outer circumferential surface of the spool 52 to supply hydraulic oil that is circulated through the supply flow path 47 to one of the advance angle flow path 43, the retardation angle flow path 44, and the unlock flow path 45. Further, a first through-hole 52*e* and a second through-hole 52*f* are formed in the spool 52 to discharge hydraulic oil, to the main discharge flow path 52*b*, which is circulated through the advance angle flow path 43, the retardation angle flow path 44, and the unlock flow path 45. The first through-hole 52*e* and the second through-hole 52*f* are connected to a ninth annular groove 52*h* and a tenth annular groove 52*i*, respectively, which are annular grooves formed on the outer circumferential surface of the spool 52. Further, a third through-hole 52*g* that discharges hydraulic oil that is circulated through the main discharge flow path 52*b* to the outside of the valve timing control apparatus 10 is formed.

Communication Path

An eleventh annular groove 52*j* (an example of a communication path) is formed at a position between the eighth annular groove 52*d* and the first through-hole 52*e*. In the OCV 51, in a case where the spool 52 is operated to move to a first retardation angle position PB1 as a second position, the sixth supply section 47*f* and the third annular groove 47*i* communicate with each other through the eleventh annular groove 52*j*. In this manner, the advance angle flow path 43 (advance angle chamber 41) enters into a state of communicating with the retardation angle flow path 44 (retardation angle chamber 42). That is, in the first retardation angle position PB1, the eleventh annular groove 52*j* allows hydraulic oil to be circulated through the advance angle chamber 41 and the retardation angle chamber 42.

Outline of Operational Mode of OCV

As shown in FIG. 4 to FIG. 8, the spool 52 of the OCV 51 of the embodiment is configured to be operated to move to five positions of the first advance angle position PA1, a second advance angle position PA2, a phase maintaining position PL, a second retardation angle position PB2, and the first retardation angle position PB1. In addition, FIG. 3 shows supply and discharge patterns in these positions.

In this configuration, the OCV 51 moves to the second advance angle position PA2, the phase maintaining position PL, and the second retardation angle position PB2, which means that the valve enters into an unlocked state in which a fluid is supplied to the unlock flow path 45 and the supplying and discharging of hydraulic oil to and from the advance angle flow path 43 and the retardation angle flow path 44 are controlled. In addition, at the first advance angle position PA1 and the first retardation angle position PB1, a locked state is performed in which the discharging of the hydraulic oil from the unlock flow path 45 and the locking discharge flow path 46 and the supplying of the hydraulic oil to one of the advance angle flow path 43 and the retardation angle flow path 44 are controlled.

In the OCV 51, in a state in which no power is supplied to the electromagnetic solenoid 54, the spool 52 is disposed at the first advance angle position PA1 and is switched to the second advance angle position PA2, the phase maintaining position PL, the second retardation angle position PB2, and the first retardation angle position PB1 by increasing power supply to the electromagnetic solenoid 54 by predetermined values, respectively, in this order.

(1) First Advance Angle Position

As shown in FIG. 4, when a current supplied to the electromagnetic solenoid 54 is zero (power supply amount is zero), the OCV 51 is disposed at the first advance angle position PA1 and the spool 52 comes into contact with the stopper 55 due to the bias force of the first valve spring 53*a* and is positioned on the farthest left side. In this state, when the hydraulic oil is supplied to the supply flow path 47, the hydraulic oil is circulated through the first supply section 47*a*, the second supply section 47*b*, and the third supply section 47*c*. When hydraulic pressure acting on the check valve 48 becomes higher in the third supply section 47*c* than a bias force of the second valve spring 53*b*, the check valve 48 is opened. Thus, the hydraulic oil is circulated through the fourth supply section 47*d*, the fifth supply section 47*e*, and the sixth supply sections 47*f*, reaches the seventh annular groove 52*c* through the first annular groove 47*g*, and reaches the eighth annular groove 52*d* through the fourth annular groove 47*j*.

The seventh annular groove 52*c* is not connected to any flow path and thus, the hydraulic oil does not flow from there any farther. Since the eighth annular groove 52*d* is connected to the advance angle flow path 43 through the third annular groove 47*i*, the hydraulic oil is circulated through the advance angle flow path 43 and is supplied to the advance angle chamber 41. That is, the advance angle flow path 43 has a supply state. The retardation angle flow path 44 is connected to the second through-hole 52*f* through the fifth annular groove 47*k* and the tenth annular groove 52*i* and the unlock flow path 45 is connected to the first through-hole 52*e* through the second annular groove 47*h* and the ninth annular groove 52*h*. Therefore, the hydraulic oil in the retardation angle chamber 42, the first recessed portion 85, and the second recessed portion 86 is discharged from the main discharge flow path 52*b* through the third through-hole 52*g* to the outside of the valve timing control apparatus 10. That is, both the retardation angle flow path 44 and the unlock flow path 45 are in a drain state. Thus, as shown in FIG. 3, at the first advance angle position PA1, the hydraulic oil is discharged from the intermediate lock mechanism 8 (the first recessed portion 85 and the second recessed portion 86) and the retardation angle chamber 42 and the advance angle chamber 41 enters into a state in which hydraulic oil is supplied thereto, which means a "lock at an intermediate lock phase P due to an advance angle operation".

(2) Second Advance Angle Position

Figure 5:
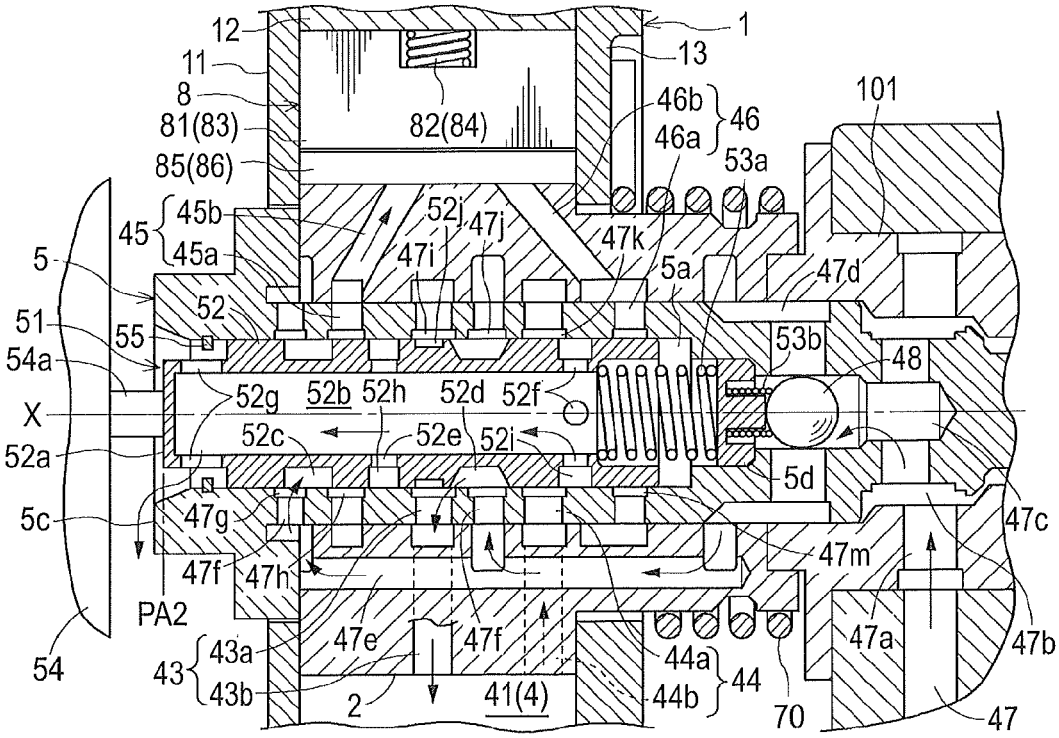
FIG. 5 is an enlarged sectional diagram showing an operation state of the OCV in PA2.

As shown in FIG. 5, when power starts to be supplied to the electromagnetic solenoid 54, the OCV 51 is disposed at the second advance angle position PA2 in FIG. 3 and the spool 52 slightly moves to the right side from the first advance angle position PA1. In this state, when the hydraulic oil is supplied to the supply flow path 47, the hydraulic oil reaches the seventh annular groove 52*c* and the eighth annular groove 52*d*. Since the seventh annular groove 52*c* is connected to the unlock flow path 45 through the second annular groove 47*h*, the hydraulic oil is circulated through the unlock flow path 45 and is supplied to the first recessed portion 85 and the second recessed portion 86. That is, the unlock flow path 45 is switched to a supply state. When the hydraulic pressure of the supplied hydraulic oil is higher than the bias force of the first spring 82 and the second spring 84, the first lock member 81 and the second lock member 83 are separated from the first recessed portion 85 and the second recessed portion 86, respectively, and enter into the unlocked state. FIG. 5 shows a state immediately after switching from the first advance angle position PA1 to the second advance angle position PA2.

Since the eighth annular groove 52*d* is continuously connected to the advance angle flow path 43, the hydraulic oil is circulated through the advance angle flow path 43 and is supplied to the advance angle chamber 41. That is, the advance angle flow path 43 is in a supply state. Since the retardation angle flow path 44 is continuously connected to the second through-hole 52*f*, the hydraulic oil in the retardation angle chamber 42 is discharged from the main discharge flow path 52*b* through the third through-hole 52*g* to the outside of the valve timing control apparatus 10. That is, the retardation angle flow path 44 is in the drain state. Thus, as shown in FIG. 3, at the second advance angle position PA2, the hydraulic oil is supplied to the intermediate lock mechanism 8 (the first recessed portion 85 and the second recessed portion 86) and the advance angle chamber 41 and hydraulic oil is discharged from the retardation angle chamber 42 such that the relative rotational phase is shifted to the advance angle direction S1, which means an "advance angle operation in the unlocked state".

(3) Phase Maintaining Position

Figure 6:
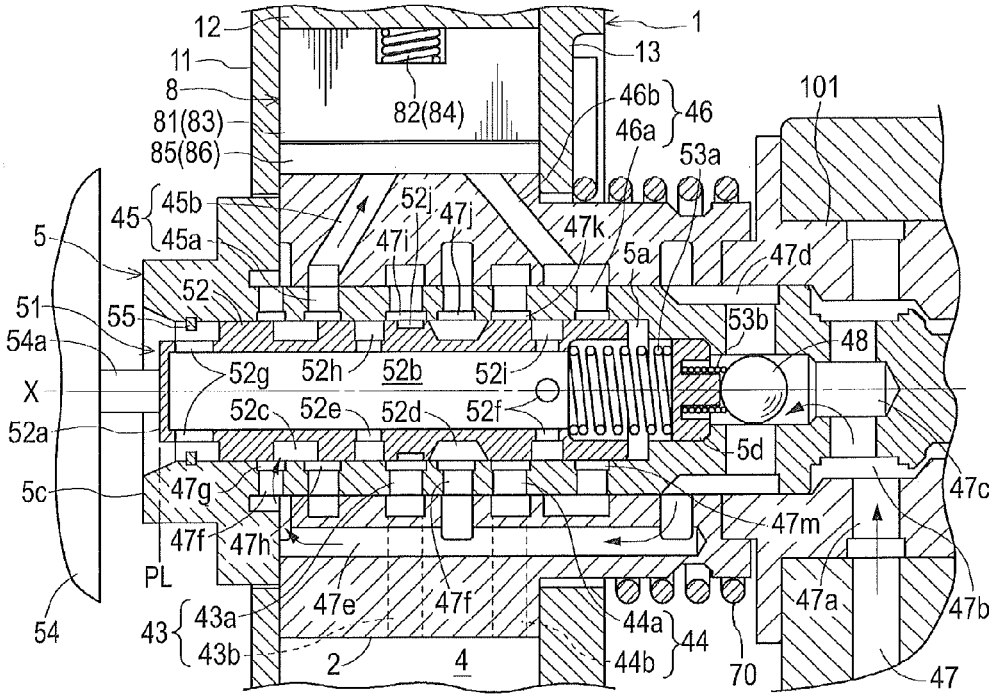
FIG. 6 is an enlarged sectional diagram showing an operation state of the OCV in PL.

As shown in FIG. 6, when a power supply amount to the electromagnetic solenoid 54 is increased and the OCV 51 is disposed at the phase maintaining position PL in FIG. 3, the spool 52 slightly moves to the right side from the second advance angle position PA2. In this state, when the hydraulic oil is supplied to the supply flow path 47, the hydraulic oil reaches the seventh annular groove 52*c* and the eighth annular groove 52*d*. Since the seventh annular groove 52*c* is continuously connected to the unlock flow path 45, the hydraulic oil is circulated through the unlock flow path 45 and is supplied to the first recessed portion 85 and the second recessed portion 86. That is, the unlock flow path 45 is in the supply state. Thus, even at the phase maintaining position PL, the unlocked state is continuously maintained from the second advance angle position PA2. FIG. 6 shows a state of the vicinity of the center of the phase maintaining position PL shown in FIG. 3.

The eighth annular groove 52*d* is not connected to any flow path and thus, the hydraulic oil does not flow from there any farther. That is, the hydraulic oil is not supplied to the advance angle flow path 43 and the retardation angle flow path 44. In addition, since the advance angle flow path 43 and the retardation angle flow path 44 are not connected to any flow path of the first through-hole 52*e* or the second through-hole 52*f*, the hydraulic oil in the advance angle chamber 41 and the retardation angle chamber 42 is not discharged to the outside of the valve timing control apparatus 10. Accordingly, when the OCV 51 is controlled to the phase maintaining position PL, the hydraulic oil is neither supplied to nor discharged from the advance angle chamber 41 and the retardation angle chamber 42. Therefore, the inner rotor 2 maintains the relative rotational phase at that time and does not move in the advance angle direction S1 or in the retardation angle direction S2. Thus, as shown in FIG. 3, at the phase maintaining position PL, the hydraulic oil is supplied to the intermediate lock mechanism 8 (the first recessed portion 85 and the second recessed portion 86), but the hydraulic oil is neither supplied to nor discharged from the advance angle chamber 41 and the retardation angle chamber 42 such that the relative rotational phase is maintained, which means an "intermediate phase maintenance".

(4) Second Retardation Angle Position

Figure 7:
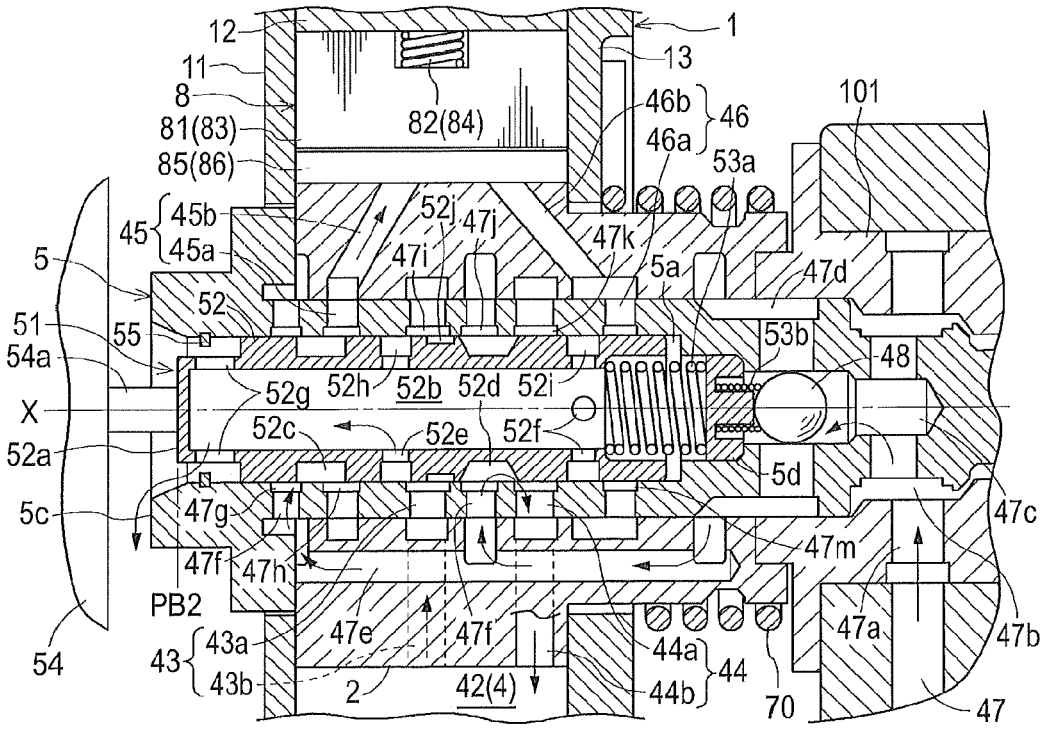
FIG. 7 is an enlarged sectional diagram showing an operation state of the OCV in PB2.

As shown in FIG. 7, when a power supply amount to the electromagnetic solenoid 54 is increased and the OCV 51 is disposed at the second retardation angle position PB2 in FIG. 3, the spool 52 slightly moves to the right side from the phase maintaining position PL. In this state, when the hydraulic oil is supplied to the supply flow path 47, the hydraulic oil reaches the seventh annular groove 52*c* and the eighth annular groove 52*d*. Since the seventh annular groove 52*c* is continuously connected to the unlock flow path 45, the hydraulic oil is circulated through the unlock flow path 45 and is supplied to the first recessed portion 85 and the second recessed portion 86. That is, the unlock flow path 45 is in the supply state. Thus, even at the second retardation angle position PB2, the unlocked state is continuously maintained from the second advance angle position PA2 and the phase maintaining position PL. FIG. 7 shows a state immediately after switching from the phase maintaining position PL to the second retardation angle position PB2.

Since, at the second retardation angle position PB2, the eighth annular groove 52*d* is connected to the retardation angle flow path 44 through the fifth annular groove 47*k*, the hydraulic oil is circulated through the retardation angle flow path 44 and is supplied to the retardation angle chamber 42. That is, the retardation angle flow path 44 is in the supply state. Since the advance angle flow path 43 is connected to the first through-hole 52*e* through the third annular groove 47*i* and the ninth annular groove 52*h*, the hydraulic oil in the advance angle chamber 41 is discharged from the main discharge flow path 52*b* through the third through-hole 52*g* to the outside of the valve timing control apparatus 10. That is, the advance angle flow path 43 is in the drain state. Accordingly, as shown in FIG. 3, at the second retardation angle position PB2, the hydraulic oil is supplied to the intermediate lock mechanism 8 (the first recessed portion 85 and the second recessed portion 86) and the retardation angle chamber 42 and hydraulic oil is discharged from the advance angle chamber 41 such that the relative rotational phase is shifted to the retardation angle direction S2, which means a "retardation angle operation in an unlocked state".

(5) First Retardation Angle Position

Figures 8, 9:
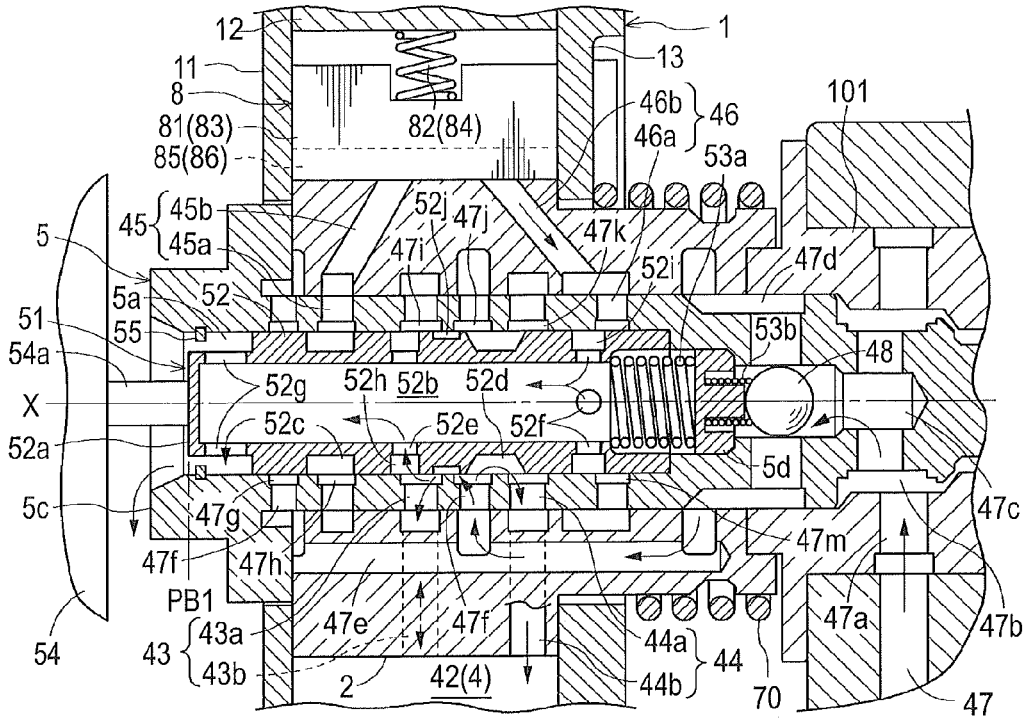
FIG. 8 is an enlarged sectional diagram showing an operation state of the OCV in PB1.
FIG. 9 shows a position of an OCV and a supply and discharge pattern of hydraulic oil according to a second embodiment.

A power supply amount to the electromagnetic solenoid 54 is increased at the second retardation angle position PB2 and thereby, the spool 52 further moves to the right side from the first retardation angle position PB1 (FIG. 8). In this state, when the hydraulic oil is supplied to the supply flow path 47, the hydraulic oil discharged from the advance angle chamber 41 is circulated through the advance angle flow path 43. The hydraulic oil which is circulated through the retardation angle flow path 44 is supplied to the retardation angle chamber 42. At this time, the advance angle chamber 41 and the retardation angle chamber 42 communicate with each other through the eleventh annular groove 52*j* (an example of the communication path). The hydraulic oil which is circulated through the unlock flow path 45 is continuously circulated through the seventh annular groove 52*c*, the seventh annular groove 52*c* does not face the first annular groove 47*g*, and the hydraulic oil does not flow through the unlock flow path 45.

At the first retardation angle position PB1, the hydraulic oil in the intermediate lock mechanism 8 is circulated through the locking discharge flow path 46 alone, is discharged to the main discharge flow path 52*b* from the second through-hole 52*f* through the sixth annular groove 47*m* and the tenth annular groove 52*i* and is discharged to the outside of the valve timing control apparatus 10 through the third through-hole 52*g*. Hereinafter, at the first retardation angle position PB1 according to the present embodiment, the locking discharge flow path 46, the sixth annular groove 47*m*, the tenth annular groove 52*i*, and the second through-hole 52*f* are collectively referred to as the second discharge flow path.

As shown in FIG. 3, at the first retardation angle position PB1, the hydraulic oil is discharged from the intermediate lock mechanism 8 (the first recessed portion 85 and the second recessed portion 86) and the advance angle chamber 41 and hydraulic oil is supplied to the retardation angle chamber 42, which means a "lock at the intermediate lock phase P due to the retardation angle operation".

Regarding Operation of OCV when Engine is Stopped

In a state in which the engine E is stopped, power is not supplied to the electromagnetic solenoid 54 and thus, the spool 52 of the OCV 51 is disposed at the first advance angle position PA1. That is, when a current supplied to the OCV 51 is zero, the intermediate lock mechanism 8 enters into the locked state, the advance angle chamber 41 and the retardation angle chamber 42 do not communicate with each other, hydraulic oil is supplied to one (advance angle chamber 41 according to the present embodiment) of the advance angle chamber 41 and the retardation angle chamber 42, and the hydraulic oil is discharged from the other chamber (retardation angle chamber 42 according to the present embodiment). Thus, when power is not supplied to the OCV 51 after the engine is stopped, it is possible to cause a certain amount of hydraulic oil to remain in one of the advance angle chamber 41 and the retardation angle chamber 42.

In this manner, a certain amount of the hydraulic oil is held in the fluid pressure chamber 4, cam swinging torque is alleviated by the hydraulic oil even though the engine E starts not from the locked state but from the intermediate phase. In this manner, it is possible to avoid a defect of deforming of the housing 1 or the inner rotor 2 by being contact with the housing 1 in the fluid pressure chamber 4 formed by partitioning.

Regarding Operation of OCV when Engine is Started

When an ignition turns on, for example, at the time of starting the engine E, the ECU 90 instructs the maximum power supply to the electromagnetic solenoid 54. In this manner, the spool 52 of the OCV 51 moves to the first retardation angle position PB1 and the advance angle chamber 41 and the retardation angle chamber 42 communicate with each other through the eleventh annular groove 52*j*. That is, when a current is supplied to the OCV 51, the intermediate lock mechanism 8 enters into the locked state, the advance angle chamber 41 and the retardation angle chamber 42 communicate with each other through the eleventh annular groove 52*j* formed in the spool 52, and a part of hydraulic oil is supplied to one (retardation angle chamber 42 according to the present embodiment) of the advance angle chamber 41 and the retardation angle chamber 42, and a part of the hydraulic oil is supplied to the other chamber (advance angle chamber 41 according to the present embodiment) through the eleventh annular groove 52*j*. In addition, the eleventh annular groove 52*j* is connected to the first through-hole 52*e* through the advance angle flow path 43. Therefore, a part of the hydraulic oil which is supplied to the retardation angle chamber 42 and flows through the eleventh annular groove 52*j* is discharged from the main discharge flow path 52*b* through the third through-hole 52*g* to the outside of the valve timing control apparatus 10.

In this manner, power is supplied to the OCV 51 and thereby, the advance angle chamber 41 and the retardation angle chamber 42 communicate with each other before cranking is started. Accordingly, since the hydraulic oil supplied to one of the advance angle chamber 41 and the retardation angle chamber 42 is also supplied to the other chamber of the advance angle chamber 41 and the retardation angle chamber 42 through the eleventh annular groove 52*j*, it is possible to rapidly fill the advance angle chamber 41 and the retardation angle chamber 42 with the hydraulic oil when the engine E is started.

Second Embodiment

Next, a second embodiment will be described with reference to FIG. 9 and FIG. 10. According to the present embodiment, only a part that is different from the first embodiment in FIG. 1 to FIG. 8 will be described. The present embodiment is configured such that the discharging of the hydraulic oil is controlled at the first retardation angle position PB1 shown in FIG. 9. Specifically, the hydraulic oil is discharged from the advance angle chamber 41 at the first retardation angle position PB1-(2), the hydraulic oil is supplied to the retardation angle chamber 42, and the hydraulic oil is discharged from the first recessed portion 85 and the second recessed portion 86. For example, the lock is unlocked at the second advance angle position PA2 such that, when switching to the locked state from a state in which the relative rotational phase moves in the direction toward the advance angle from the intermediate lock phase P is performed, the hydraulic oil is discharged from the advance angle chamber 41 and the hydraulic oil is supplied only to the retardation angle chamber 42 due to the providing of the first retardation angle position PB1-(2). Thus, it is possible to shift the relative rotational phase due to differential pressure between the advance angle chamber 41 and the retardation angle chamber 42 and it is possible to move the lock members 81 and 82 to the corresponding first recessed portion 85 and the second recessed portion 86 such that it is possible to reliably perform locking by further discharging the hydraulic oil from the first recessed portion 85 and the second recessed portion 86.

Next, unique effects achieved when the spool 52 moves from the first retardation angle position PB1-(1) corresponding to FIG. 8 to the first retardation angle position PB1-(2) corresponding to FIG. 10 will be described. According to the present embodiment, the power supply amount to the OCV 51 is changed by the ECU 90 and the spool 52 is caused to move from a communication position (FIG. 8) at which the advance angle chamber 41 and the retardation angle chamber 42 communicate with each other through the eleventh annular groove 52*j*, to a non-communication position (FIG. 10). FIG. 9 shows an operational configuration of the OCV 51 according to the present embodiment when the position of the spool 52 is shifted to the PA1 to PB1 in response to the power supply amount to the electromagnetic solenoid 54.

Figure 10:
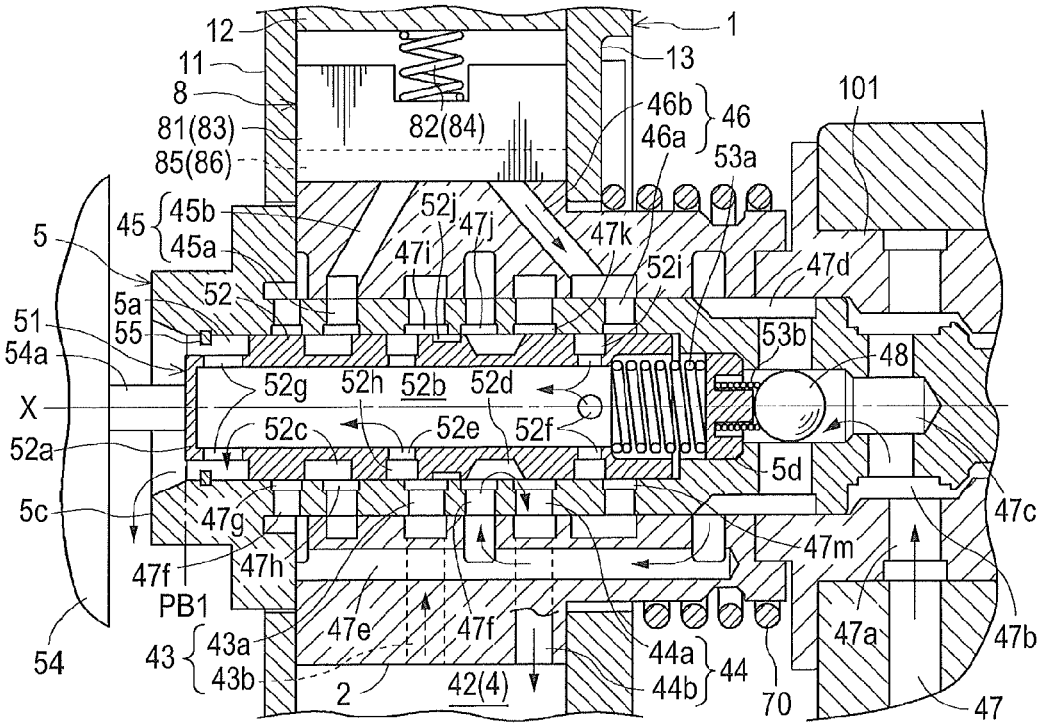
FIG. 10 is an enlarged sectional diagram showing an operation state of the OCV in PB1.

Specifically, the power supply amount to the electromagnetic solenoid 54 is caused to be reduced by the ECU 90 such that the spool 52 at the first retardation angle position PB1 is caused to move in a state shown in FIG. 8 to the left side (FIG. 10). In this manner, the supply flow path 47 and the advance angle flow path 43 (drain) have a blocked state of not communicating with each other through the eleventh annular groove 52*j* and the hydraulic oil supplied from the supply flow path 47 is not discharged. In this manner, it is possible to efficiently use the hydraulic oil that is supplied to the fluid pressure chamber 4.

For example, the ECU 90 causes the spool 52 to move to the non-communication position after the spool 52 moves to the communication position and a predetermined period of time elapses. In this manner, it is possible to control the OCV 51 only by setting a period of time for which the fluid pressure chamber 4 is completely filled with the hydraulic oil, as the predetermined time, and it is possible to simplify the configuration of the ECU 90.

The period of time which is taken for completely filling the fluid pressure chamber 4 with the hydraulic oil is changed based on a temperature of the hydraulic oil in the fluid pressure chamber 4 or a water temperature inside the engine E. Therefore, the predetermined period of time described above may be determined based on the temperature of the hydraulic oil in the fluid pressure chamber 4 or the water temperature inside the engine E. In this manner, since the predetermined period of time is set by the ECU 90 with high accuracy, it is possible to suppress the discharge of the hydraulic oil.

Modification Example of Second Embodiment (1) According to the second embodiment, an example in which the spool 52 of the OCV 51 is caused to move to the non-communication position based on a period of time which elapses after the spool moves to the communication position is described. Instead, the spool 52 may be caused to move to the non-communication position (FIG. 10) from the communication position (FIG. 8) based on a pressure change in the fluid pressure chamber 4.

When the fluid pressure chamber 4 is supplied with a hydraulic fluid and is filled with the hydraulic oil, a pressure in the fluid pressure chamber 4 increases to a predetermined threshold value or greater. Using this, according to the present embodiment, the ECU 90 causes the spool 52 to move to the non-communication position from the communication position when the pressure in the fluid pressure chamber 4 becomes the predetermined threshold value or greater. In this manner, it is possible to cause the spool 52 to move to the non-communication position immediately after the fluid pressure chamber 4 is completely filled with the hydraulic oil and it is possible to effectively suppress wasteful discharge of the hydraulic oil.

(2) According to the above embodiment, an example is described, in which the spool 52 has an annular groove (eleventh annular groove 52*j*) formed as the communication path through which the advance angle chamber 41 and the retardation angle chamber 42 communicate with each other. However, the annular groove may not be formed but a groove portion may be formed partially in a circumferential direction as long as the advance angle chamber 41 and the retardation angle chamber 42 communicate with each other. Alternatively, a through-hole as a communication path may be formed in the spool 52.

(3) According to the above embodiment, a configuration is described, in which the unlock flow path 45 and the locking discharge flow path 46 are provided as flow paths that communicate with the intermediate lock mechanism 8. However, a configuration may be employed, in which only the unlock flow path 45 is provided as the flow path that communicates with the intermediate lock mechanism 8.

(4) According to the above embodiment, an example is described, in which the OCV 51 is configured to enter into the locked state of the advance angle control when the power supply amount is zero and a locked state of the retardation angle control when the power supply amount becomes the maximum value. However, the OCV 51 may be configured to enter into the locked state of the retardation angle control when the power supply amount is zero and to enter into the locked state of the advance angle control when the power supply amount becomes the maximum value.

Third Embodiment

Basic Configuration

Figure 11:
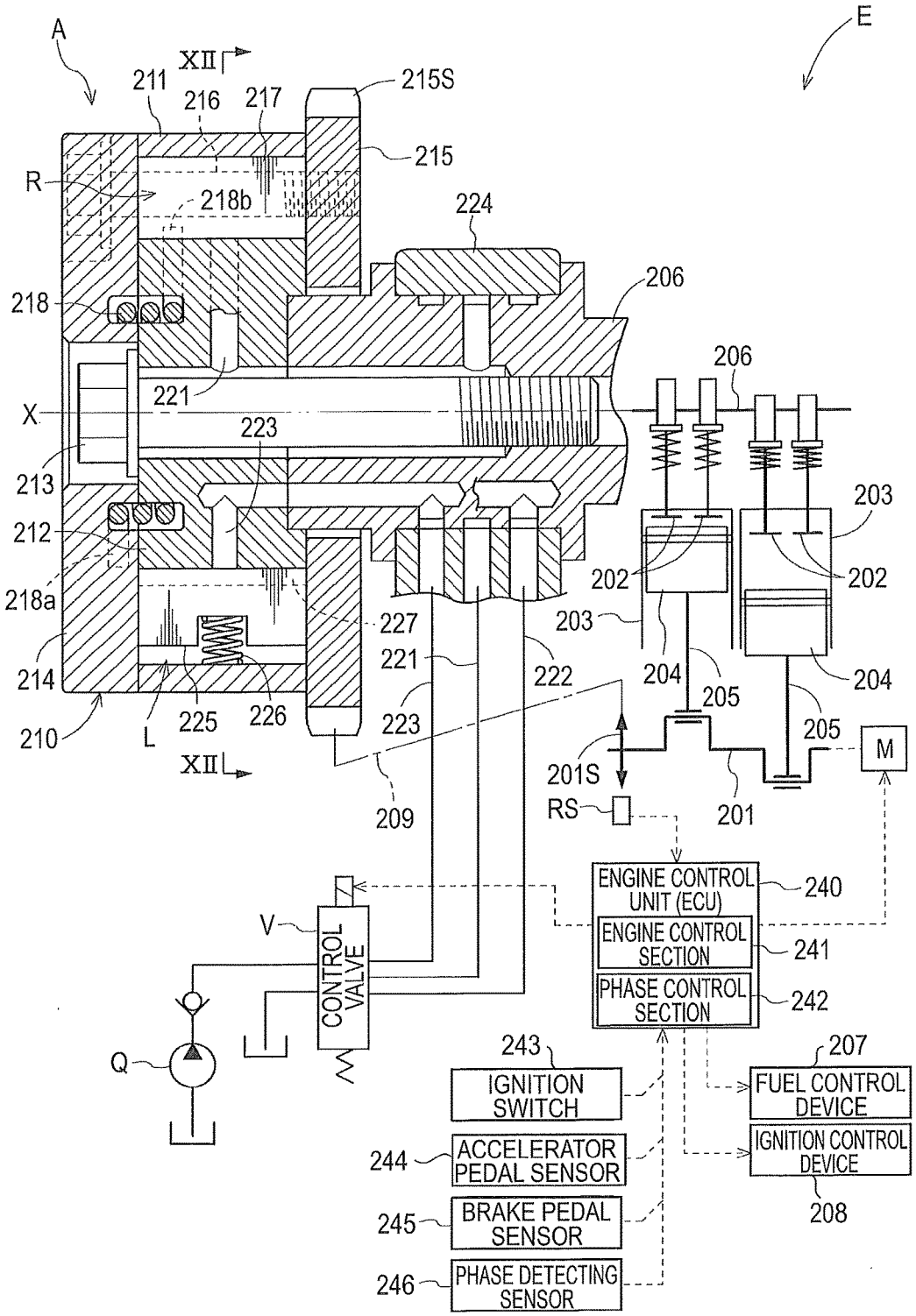
FIG. 11 is a diagram showing a section of a valve timing control apparatus and a control system according to a third embodiment.
Figure 12:
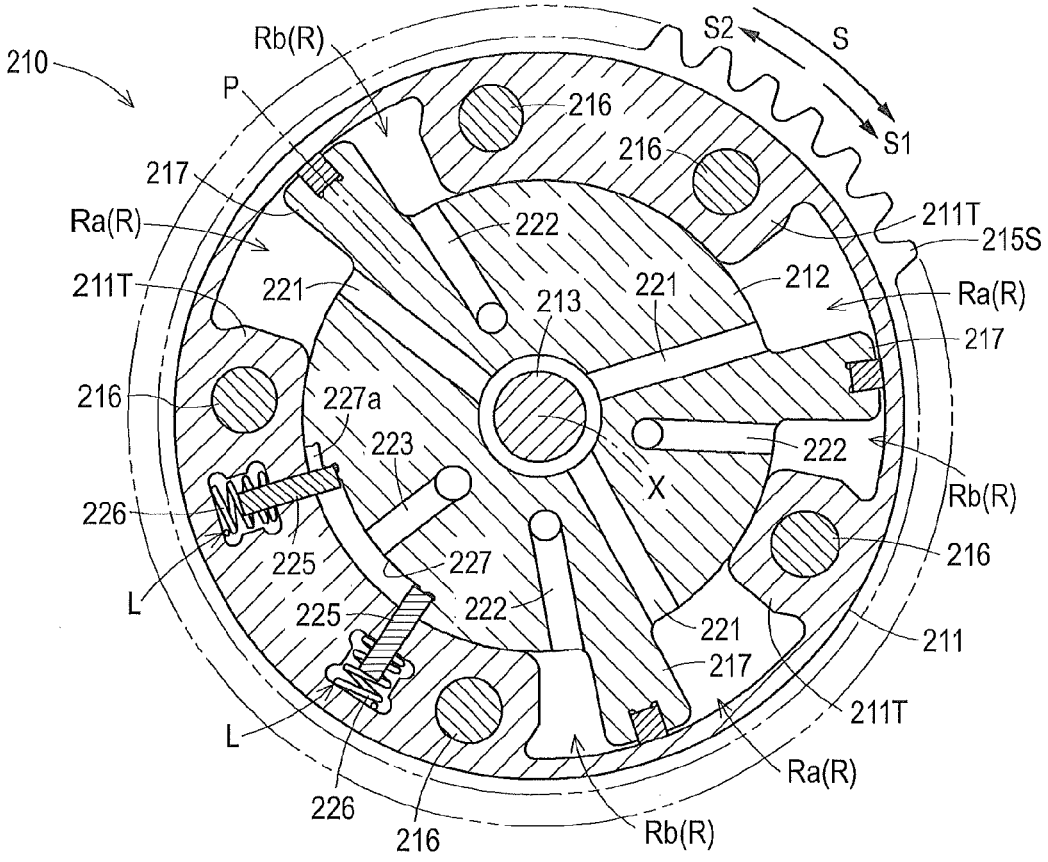
FIG. 12 is a sectional diagram taken along line XII-XII in FIG. 11.

As shown in FIG. 11 and FIG. 12, an internal combustion engine control system is configured to include a valve timing control apparatus A that sets an opening/closing timing of an intake valve 202 of the engine E as the internal combustion engine, and an engine control unit (functioning as an example of a control unit, that is an ECU) 240 that controls the engine E.

The engine E shown in FIG. 11 is provided in a vehicle such as an automobile. The engine E is configured to include a crankshaft 201 as the drive shaft, to accommodate a piston 204 inside a cylinder bore of a cylinder block 203, and to be a four-cycle type in which the piston 204 and the crankshaft 201 are connected using a connecting rod 205. In the intake valve 202, an opening/closing operation is performed by rotating an intake camshaft 206.

The engine E includes a starter motor M that transmits drive torque to the crankshaft 201 when starting, a fuel control unit 207 that controls ejection of a fuel to an intake port or a fuel chamber, an ignition control unit 208 that controls ignition by spark plug (not shown), and a shaft sensor RS that detects a rotating angle and a rotating speed of the crankshaft 201.

The valve timing control apparatus A is configured to include a valve timing control unit 210 and a control valve V. The valve timing control unit 210 includes a phase detecting sensor 246 that is disposed coaxially to the shaft core X of the outer rotor 211 and the inner rotor 212 and that detects a relative rotational phase of the inner rotor 212 to the outer rotor 211. Hereinafter, the relative rotational phase of the inner rotor 212 to the outer rotor 211 is described as the relative rotational phase.

In the valve timing control unit 210, a timing chain 209 is wound over an output sprocket 201S provided on the crankshaft 201 of the engine E and also over a timing sprocket 215S of the outer rotor 211 and thereby, the outer rotor 211 synchronously rotates with the crankshaft 201. Although not shown in the drawings, a device having the same configuration as the valve timing control unit 210 is also included at the front end of a discharge camshaft on the discharge side and torque from the timing chain 209 is transmitted also to the device. In addition, the valve timing control unit 210 rotates in a drive-rotating direction S due to a drive force from the timing chain 209.

In addition, a hydraulic pump Q that is driven by the drive force of the crankshaft 201 of the engine E is provided. The hydraulic pump Q sends out the lubricant oil of the engine E as the hydraulic oil (an example of the hydraulic fluid) and the hydraulic oil is supplied to the valve timing control unit 210 through the control valve V.

The ECU 240 includes an engine control section 241 and a phase control section 242. The engine control section 241 controls the starter motor M, the fuel control unit 207, and the ignition control unit 208 to perform start and stop of the engine E. The phase control section 242 controls the relative rotational phase and a lock mechanism L (an example of the intermediate lock mechanism) of the valve timing control unit 210. A control configuration and a control aspect related to the ECU 240 will be described below.

Valve Timing Control Unit

The valve timing control unit 210 includes the outer rotor 211 as a drive-side rotational member that synchronously rotates with the crankshaft 201 of the engine E, and the inner rotor 212 as a driven-side rotational member that connects the intake valve 202 of the fuel chamber of the engine E to the intake camshaft 206 which is opened and closed by a connection bolt 213. The inner rotor 212 is fit inside the outer rotor 211 such that the shaft core of the outer rotor 211 and the shaft core of the inner rotor 212 are coaxial and thus, the inner rotor 212 and the outer rotor 211 are disposed in a relatively rotatable manner with the shaft core X as the center. In this configuration, the shaft core X is a rotating shaft core of the intake camshaft 206 and a rotating shaft core of the outer rotor 211 and the inner rotor 212.

The outer rotor 211 and the inner rotor 212 are fastened using a fastening bolt 216 in a state of being interposed between a front plate 214 and a rear plate 215. The timing sprocket 215S is formed on the outer periphery of the rear plate 215. The center portion of the inner rotor 212 is disposed in a state of penetrating an opening formed at the center of the rear plate 215 and the intake camshaft 206 is connected to the end portion of the inner rotor 212 on the rear plate 215 side.

According to the present embodiment, a configuration in which the valve timing control unit 210 is provided to the intake camshaft 206 is described; however, the valve timing control unit 210 may be provided to the discharge camshaft or the valve timing control units 210 may be provided to both the intake camshaft 206 and the discharge camshaft.

A plurality of protrusions 211T which protrude toward the inner side in the radial direction are integrally formed with the outer rotor 211 in the direction of the shaft core X. The inner rotor 212 is cylindrically formed to have an outer circumference which comes into close contact with the protruding ends of the plurality of protrusions 211T. In this manner, a plurality of fluid pressure chambers R are formed on the outer circumferential side of the inner rotor 212 at intermediate positions between the protrusions 211T adjacent in the rotating direction. A plurality of vanes 217 as dividing portions which protrude outwardly are provided on the outer circumference of the inner rotor 212.

The fluid pressure chamber R forms an advance angle chamber Ra and a retardation angle chamber Rb through dividing by the vane 217. According to the present embodiment, the vane 217 that is formed to be integral with the inner rotor 212 and protrudes to the outer side from the outer circumference of the inner rotor 212 is described; however, a plate-shaped material may be used as the vane 217 or the vane 217 may be configured to be fitted and supported on the outer circumference of the inner rotor 212.

A direction in which the inner rotor 212 rotates in the same direction as the drive-rotating direction S with respect to the outer rotor 211 is referred to as the advance angle direction S1 and a direction opposite to the advance angle direction S1 is referred to as a retardation angle direction S2. In the valve timing control unit 210, the relative rotational phase is shifted to the advance angle direction S1 by supplying the hydraulic oil (an example of a fluid) to the advance angle chamber Ra and the intake timing occurs at an earlier stage. Conversely, the relative rotational phase is shifted to the retardation angle direction S2 by supplying the hydraulic oil to the retardation angle chamber Rb and the intake timing is delayed.

Valve Timing Control Unit: Lock Mechanism

The valve timing control unit 210 includes the lock mechanism L in which the relative rotational phase is maintained in the intermediate lock phase P shown in FIG. 12. The lock mechanism L is configured to include a pair of lock members 225 which are provided to the protrusions 211T of the outer rotor 211, respectively, in an extendable and retractable way, a lock spring 226 as a bias mechanism which biases the lock member 225 in the protruding direction, and a recessed intermediate lock portion 227 (an example of an engagement portion) which is formed on the outer circumference of the inner rotor 212 such that the lock member 225 is fitted thereto. The intermediate lock phase P means that the engine E is smoothly started in a cold state in which a temperature of a fuel chamber is lowered to the outside air temperature.

A ratcheting step portion 227*a* is formed in the recessed intermediate lock portion 227 to have a shape of a groove shallower than the recessed intermediate lock portion 227 such that the relative rotational phase is continuous in the retardation angle direction S2 with the intermediate lock phase P as a reference. In this manner, in a case where the relative rotational phase is shifted from the largest retardation angle phase toward the intermediate lock phase P, one lock member 225 engages with the recessed intermediate lock portion 227 such that the shift of the relative rotational phase is prevented. Then, the other lock member 225 engages with the step portion 227*a* and further, progress to a state of being fitted to the recessed intermediate lock portion 227 is reliably made in response to a shift of the relative rotational phase in the engagement state.

The step portion 227*a* may be set at a position to be continuous from the recessed intermediate lock portion 227 in the advance angle direction S1 and may be set at two predetermined positions to be continuous in the respective advance angle direction S1 and retardation angle direction S2. In addition, the lock mechanism L may be configured to include one lock member 225 and one recessed intermediate lock portion 227.

Valve Timing Control Unit: Torsion Spring

As shown in FIG. 11 and FIG. 13 to FIG. 15, a torsion spring 218 is provided as a phase setting mechanism that causes a bias force to be applied over the inner rotor 212 and the front plate 214 in a state in which the relative rotational phase of the inner rotor 212 to the outer rotor 211 (hereinafter, referred to as the relative rotational phase) becomes the largest retardation angle phase to a state in which the relative rotational phase is disposed at the intermediate lock phase P.

During an operation of the engine E, a reactive force to the rotation of the intake camshaft 206 acts on the intake camshaft 206 in the retardation angle direction S2 and the advance angle direction S1. The reactive force is intermittently generated to be used as cam swinging torque and thus, in the present embodiment, an average value of the reactive forces (cam swinging torque) is described as a retardation angle actuating force.

A biasing direction of the torsion spring 218 is set to cause the bias force to be applied in a direction (advance angle direction S1) opposite to a direction of the average value of the reactive force (cam swinging torque) which acts on the intake camshaft 206. As shown in the graph in FIG. 23, the bias force of the torsion spring 218 is set to a value greater than the retardation angle actuating force (average value of the reactive forces) in a region of the relative rotational phase between the largest retardation angle phase to the intermediate lock phase P. In addition, in a state in which the relative rotational phase is further shifted to the largest advance angle side from the intermediate lock phase P, the torsion spring 218 is configured to have no spring force (bias force).

As a specific configuration, the torsion spring 218 has a base end 218*a* (one end) which is supported by a latching portion 214A of the front plate 214 (on the outer rotor 211 side) and a functioning end 218*b* (the other end) which is disposed at a position to be inserted in an opening 212S of the inner rotor 212 and in a recessed engagement portion 211S of the outer rotor 211.

A width of the recessed engagement portion 211S is formed to correspond to a region in which the functioning end 218*b* of the torsion spring 218 is shifted, within the region of the relative rotational phase from the largest retardation angle phase to the intermediate lock phase P. The recessed engagement portion 211S has a regulation wall 211St with which the functioning end 218*b* comes into contact when the relative rotational phase is disposed at the intermediate lock phase P.

The opening 212S is formed to correspond to the region in which the functioning end 218*b* of the torsion spring 218 is shifted, in the region of the relative rotational phase from the intermediate lock phase P to the largest advance angle. The opening 212S has a pressure receiving wall 212St with which the functioning end 218*b* comes into contact and which applies the bias force in a region of the relative rotational phase from the largest retardation angle phase to the intermediate lock phase P.

Figure 13:
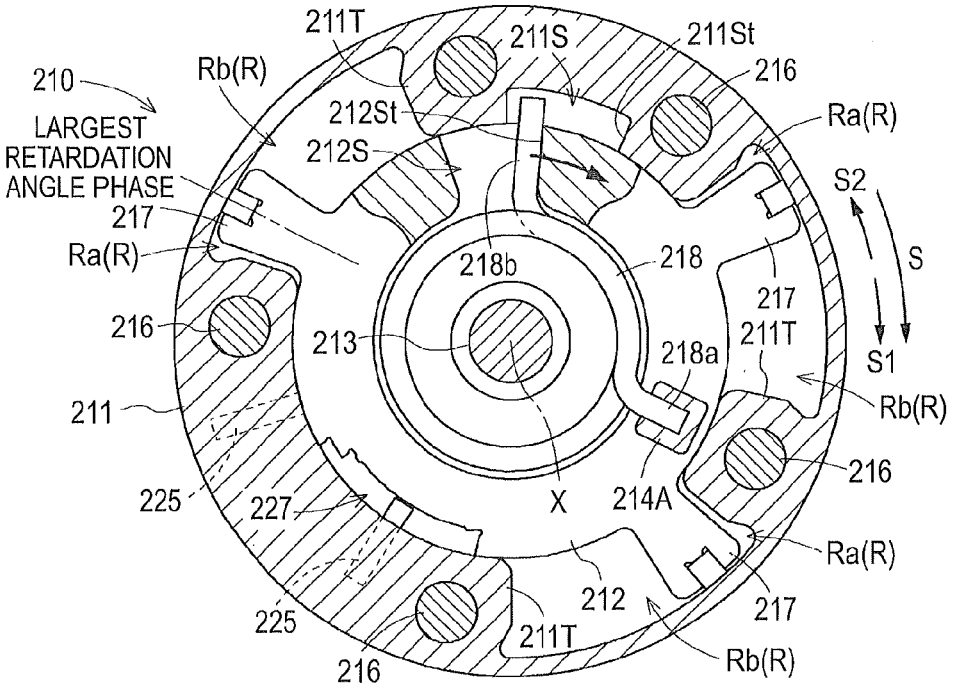
FIG. 13 is a sectional diagram showing a state of a torsion spring in the largest retardation angle phase.

In this configuration, as shown in FIG. 13, in a case where the relative rotational phase becomes the largest retardation angle phase, the functioning end 218*b* of the torsion spring 218 does not come into contact with the regulation wall 211St of the recessed engagement portion 211S, but comes into contact with the pressure receiving wall 212St of the opening 212S. In this manner, the bias force of the torsion spring 218 acts on in a direction in which the relative rotational phase is shifted in the advance angle direction S1.

Figure 14:
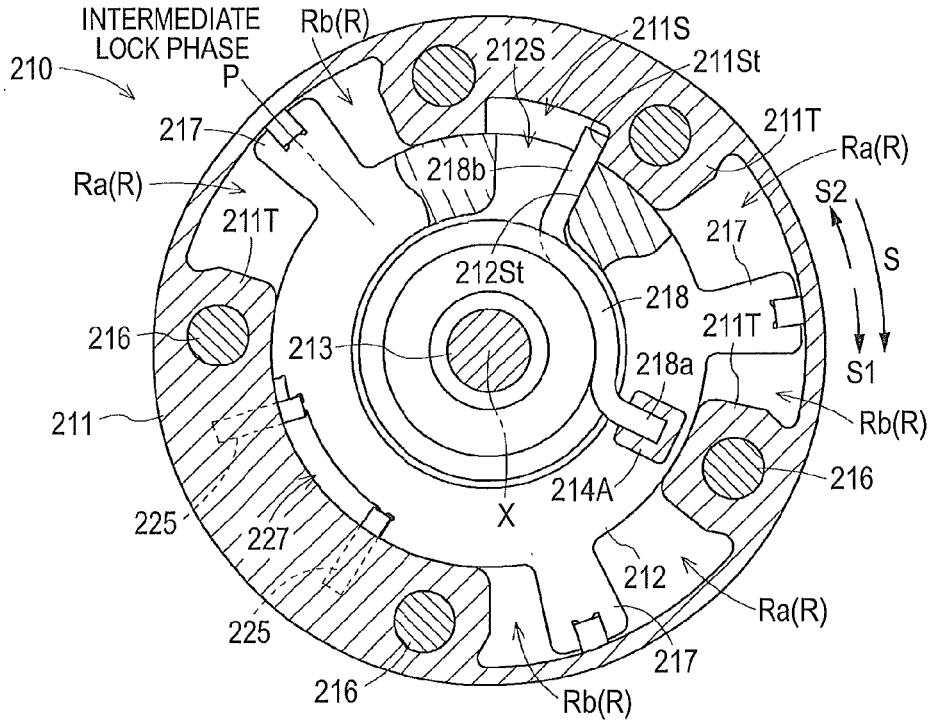
FIG. 14 is a sectional diagram showing a state of the torsion spring in an intermediate lock phase.

In addition, as shown in FIG. 14, in a case where the relative rotational phase becomes intermediate lock phase P, the functioning end 218*b* of the torsion spring 218 comes into contact with the regulation wall 211St of the recessed engagement portion 211S and into contact with the pressure receiving wall 212St of the opening 212S. In this manner, the bias force of the torsion spring 218 does not act on the inner rotor 212. Particularly, at the intermediate lock phase P, the bias force of the torsion spring 218 is balanced with the retardation angle actuating force and thereby, the relative rotational phase is maintained at the intermediate lock phase P.

Figure 15:
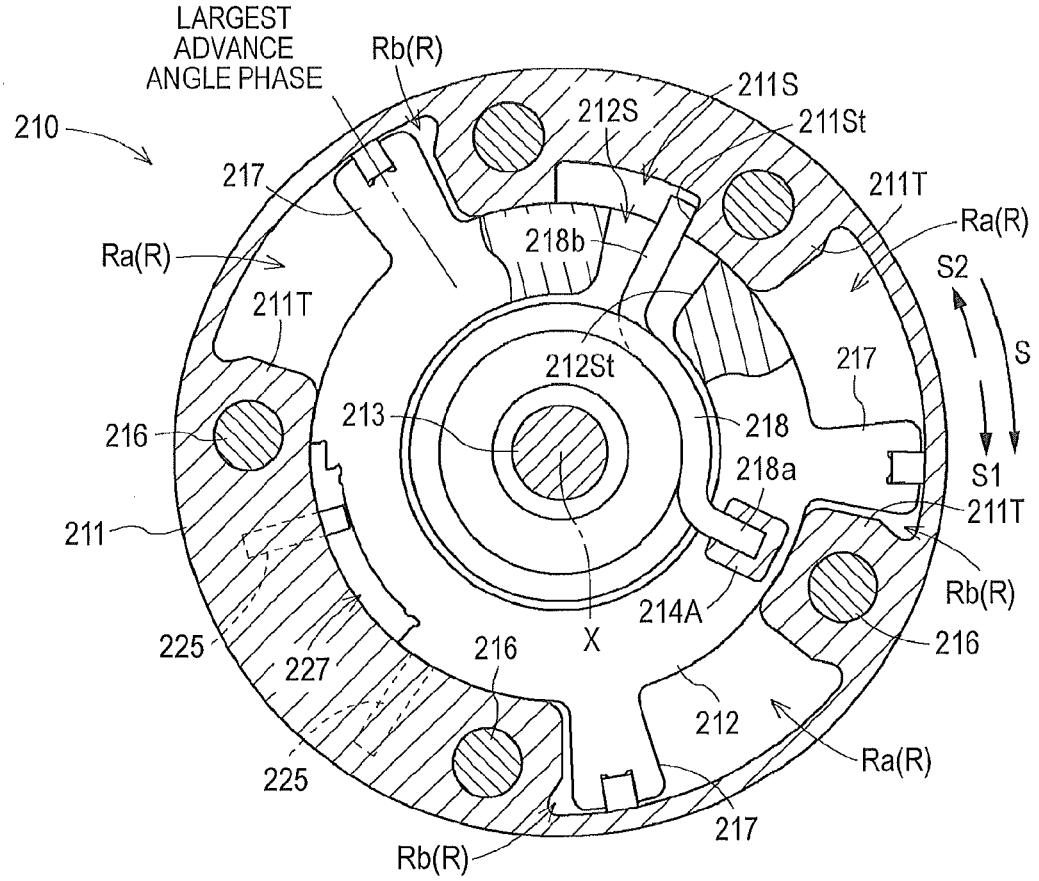
FIG. 15 is a sectional diagram showing a state of the torsion spring in the largest advance angle phase.

Further, as shown in FIG. 15, in a case where the relative rotational phase is further disposed in the advance angle direction S1 from the intermediate lock phase P and in a state in which the functioning end 218*b* of the torsion spring 218 comes into contact with the regulation wall 211St of the recessed engagement portion 211S, the pressure receiving wall 212St of the opening 212S becomes separated from the functioning end 218*b* and the bias force of the torsion spring 218 does not act on the inner rotor 212.

Modification Example of Torsion Spring

Figure 24:
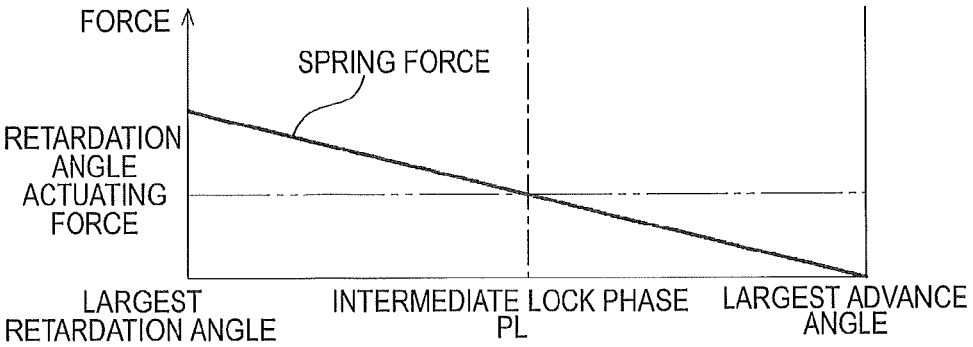
FIG. 24 is a graph showing a relationship between a relative rotational phase and a spring force according to the modification example.

As shown in the graph in FIG. 24, the spring force is set to a value greater than the retardation angle actuating force (average value of the reactive forces) in a region of the relative rotational phase between the largest retardation angle phase to the intermediate lock phase P. In addition, in a case where the relative rotational phase is disposed at the intermediate lock phase P, the spring force is equal to the retardation angle actuating force. In a state in which the relative rotational phase is further shifted to the largest advance angle side from the intermediate lock phase P, the torsion spring 218 may be configured to cause the spring force (bias force) to be less than the retardation angle actuating force.

In the modification example, the spring force is linearly changed with respect to the relative rotational phase. In this respect, the opening 212S or the recessed engagement portion 211S may not be formed and thus, the configuration is simplified.

Valve Timing Control Unit: Flow Path Configuration

An advance angle flow path 221 that communicates with the advance angle chamber Ra, a retardation angle flow path 222 that communicates with the retardation angle chamber Rb, and an unlock flow path 223 that unlocks the lock (restriction) of the lock mechanism L are formed in the inner rotor 212.

As shown in FIG. 11, a hydraulic joint section 224 is provided on the outer periphery of the intake camshaft 206 and a port that communicates with the advance angle flow path 221, the retardation angle flow path 222, and the unlock flow path 223 is formed in the hydraulic joint section 224.

The control valve V realizes control of supplying and discharging the hydraulic oil (an example of a fluid) from the hydraulic pump Q, to and from the advance angle flow path 221, the retardation angle flow path 222, and the unlock flow path 223.

Control Valve

As shown in FIG. 16 to FIG. 20, the control valve V is configured to include a cylindrical sleeve 231, a columnar spool 232 that is accommodated in the sleeve, a spool spring 233 that biases the spool 232 to an initial position (lock start position PA1 shown in FIG. 21), and an electromagnetic solenoid 234 that causes the spool 232 to operate against the bias force of the spool spring 233.

The sleeve 231 and the spool 232 are coaxially disposed and an axial core thereof is referred to as a spool axial core Y. In addition, the electromagnetic solenoid 234 is configured to have a solenoid coil 234B that is disposed on an outer periphery of a plunger 234A configured of a magnetic material such as iron. The electromagnetic solenoid 234 has a function that the more the power supply to the solenoid coil 234B is increased, the more the spool 232 is shifted against the bias force of the spool spring 233.

In a state in which no power is supplied to the electromagnetic solenoid 234, the spool 232 is positioned at the lock start position PA1 (initial position). The spool 232 is configured to be disposed through operation at an advance angle position PA2, a neutral position PL, a retardation angle position PB2, in this order, in response to an increase of the power supplied to the electromagnetic solenoid 234. In addition, FIG. 21 shows a relationship between the supply and discharge of the hydraulic oil at the positions.

In the sleeve 231, an advance angle port 231A that communicates with the advance angle flow path 221, a retardation angle port 231B that communicates with the retardation angle flow path 222, an unlock port 231L that causes unlocking pressure to act on the lock member 225 by communicating with the unlock flow path 223 are formed. In addition, in the sleeve 231, a first pump port 231Pa to which the hydraulic oil is supplied from the hydraulic pump Q, a second pump port 231Pb, and three drain ports 231D are formed.

Particularly, the advance angle port 231A and the retardation angle port 231B are disposed to have a positional relationship of being adjacent in a direction parallel to the spool axial core Y and the first pump port 231Pa and the second pump port 231Pb are disposed on a back surface side (opposite side interposing the spool axial core Y therebetween) thereof.

In the spool 232, a first land portion 232La for controlling the hydraulic oil, a second land portion 232Lb, a third land portion 232Lc, a fourth land portion 232Ld, and a fifth land portion 232Le are formed. In addition, a first groove 232Ga is formed on the electromagnetic solenoid 234 side from the first land portion 232La and a second groove 232Gb is formed between the first land portion 232La and the second land portion 232Lb. A third groove 232Gc, a fourth groove 232Gd, and a fifth groove 232Ge are formed at positions in accordance with the above description.

Lock Start Position

Figure 16:
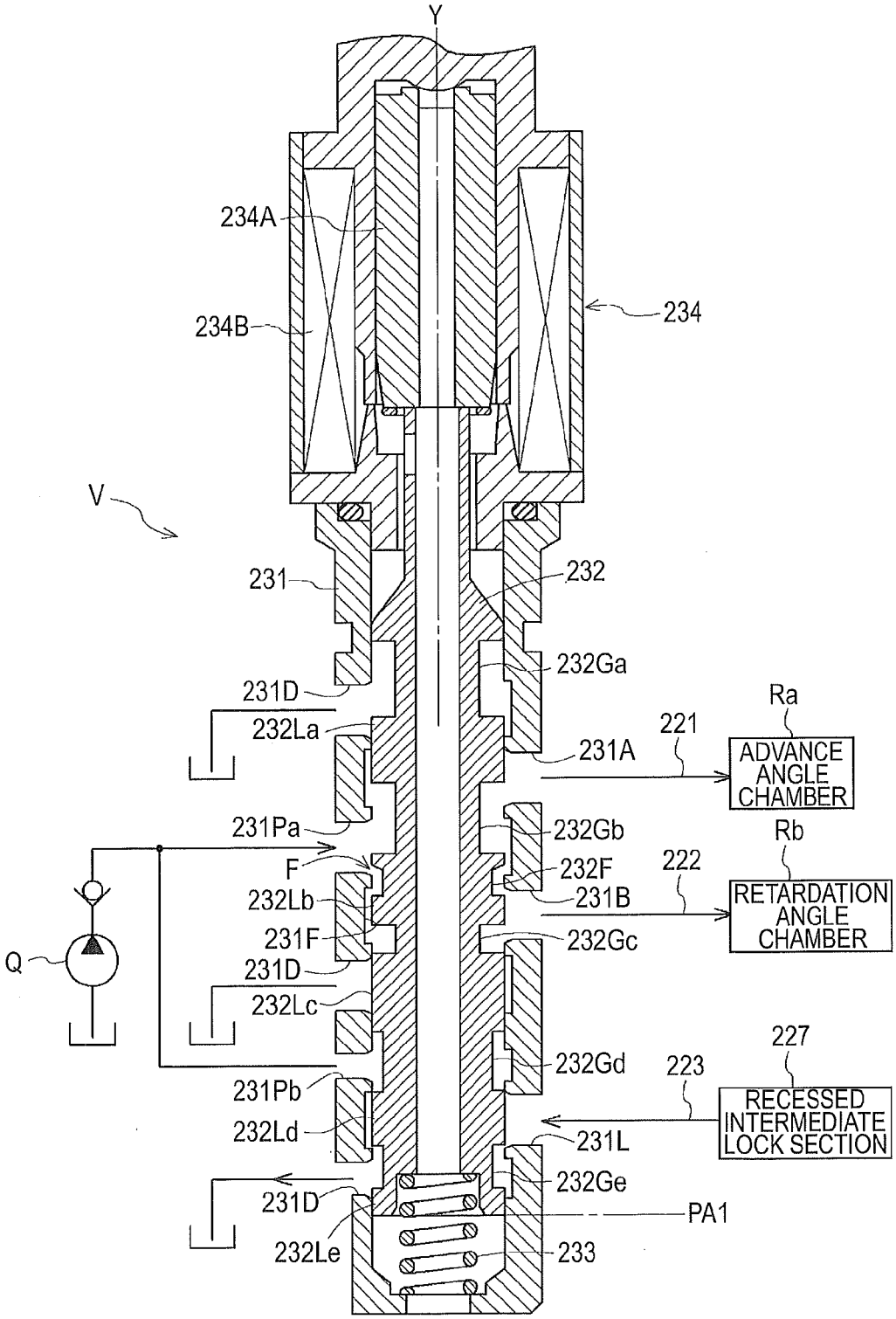
FIG. 16 is a sectional diagram showing a control valve in which a spool is disposed at a lock start position.

As shown in FIG. 16, in a case where the spool 232 is set at the lock start position PA1, the hydraulic oil from the first pump port 231Pa is supplied to the advance angle port 231A and the retardation angle port 231B and the hydraulic oil from the unlock port 231L is discharged to the drain port 231D.

Specifically, the hydraulic oil from the first pump port 231Pa is supplied to the advance angle port 231A through the second groove 232Gb. At the same time, a part of the hydraulic oil in the second groove 232Gb is supplied to the retardation angle port 231B through a divergence portion F between an outer periphery of the second land portion 232Lb and an inner periphery of the sleeve 231. In addition, the hydraulic oil from the unlock port 231L is discharged to the drain port 231D on the tip side through the fifth groove 232Ge.

The divergence portion F is configured to include a divergence groove 232F formed over the entire outer periphery of the second land portion 232Lb and a recessed divergence portion 231F formed over the entire inner periphery of the sleeve 231, which corresponds to the second land portion 232Lb. In this configuration, in a case where the spool 232 is set at the lock start position PA1, a part of the hydraulic oil in the second groove 232Gb is supplied to the retardation angle port 231B through the divergence portion F (recessed divergence portion 231F and divergence groove 232F).

That is, the hydraulic oil is supplied to the advance angle chamber Ra and the retardation angle chamber Rb and the hydraulic oil is discharged from the unlock port 231L such that the lock mechanism can enter into the locked state.

Thus, at the lock start position PA1, the relative rotational phase is not shifted due to the pressure of the hydraulic oil. For example, in a case where the relative rotational phase is disposed on the retardation angle side from the intermediate lock phase P, the relative rotational phase is shifted in the advance angle direction S1 due to the bias force of the torsion spring 218 and the lock mechanism L can enter into the locked state at the time when the relative rotational phase reaches the intermediate lock phase P shown in FIG. 12.

Conversely, in a case where the relative rotational phase is disposed on the advance angle side from the intermediate lock phase P, the relative rotational phase is shifted in the retardation angle direction S2 due to the retardation angle actuating force from the intake camshaft 206 which is applied in the retardation angle direction S2 and the lock mechanism L can enter into the locked state at the time when the relative rotational phase reaches the intermediate lock phase P shown in FIG. 12.

Figure 17:
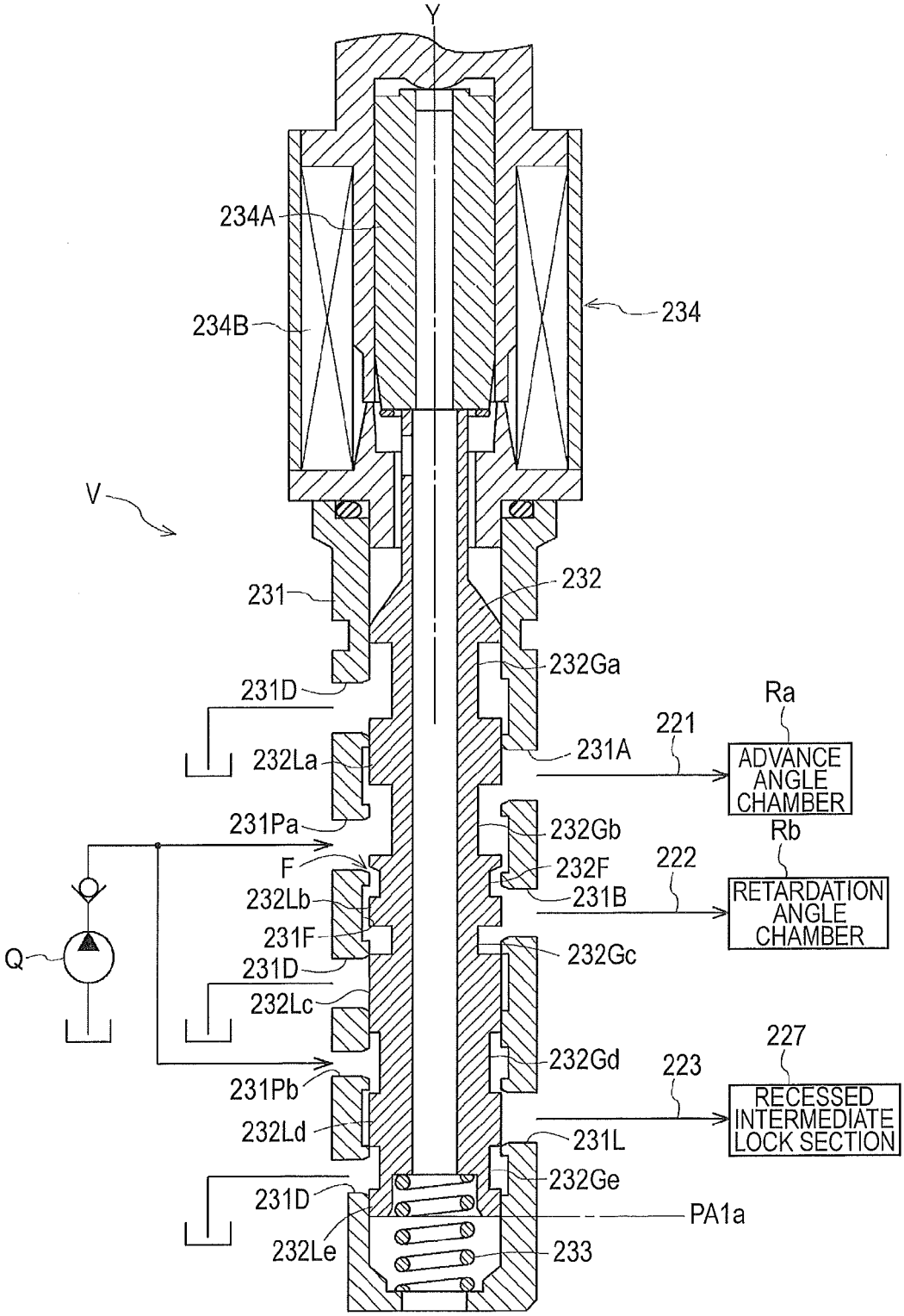
FIG. 17 is a sectional diagram showing the control valve in which the spool is disposed at a transition position.

In a case where the spool 232 starts to move from the lock start position PA1 to the advance angle position PA2, the control valve V is configured to maintain a state of supplying the hydraulic oil to the advance angle chamber Ra and the retardation angle chamber Rb at a transition position PA1*a* shown in FIG. 17 in a process of a movement, to supply the hydraulic oil to the recessed intermediate lock portion 227, and to easily unlock the lock mechanism L. The spool 232 is not held at the transition position PA1*a* in the control. In this disclosure, the control valve V may be configured to have only the lock start position PA1 on the functioning end of the spool 232 and the transition position PA1*a* may be formed.

As will be described below, at the advance angle position PA2, the hydraulic oil is supplied to the advance angle port 231A, the hydraulic oil from the retardation angle port 231B is discharged, and the hydraulic oil is supplied to the unlock port 231L. That is, at the advance angle position PA2, an operation of causing the relative rotational phase to be shifted in the advance angle direction S1 and control of unlocking the lock mechanism L are performed at the same time. In such an operational aspect, a shear force is applied to the lock member 225 in a shear direction from the outer rotor 211 and the inner rotor 212 and it is difficult to unlock the lock member 225 in some cases.

In order to solve the difficulty of unlocking, at the transition position PA1*a*, while a state of supplying the hydraulic oil from the first pump port 231Pa to the advance angle port 231A and the retardation angle port 231B as shown in FIG. 17 is maintained, the hydraulic oil from the second pump port 231Pb is supplied to the unlock port 231L through the fourth groove 232Gd. In this manner, the lock member 225 is separated from the recessed intermediate lock portion 227 without the shear force applied thereto such that the unlocking is easily performed.

Advance Angle Position

Figure 18:
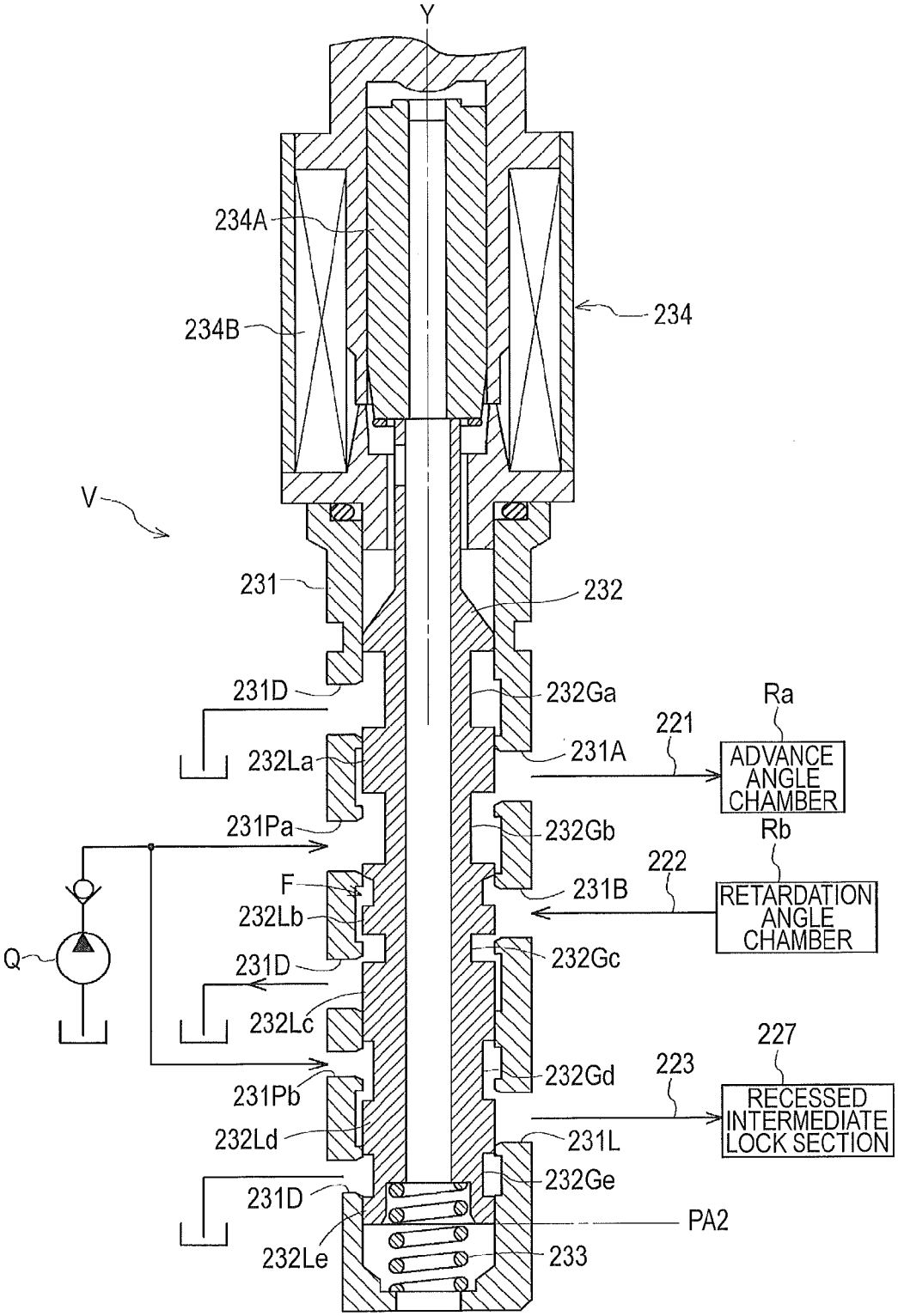
FIG. 18 is a sectional diagram showing the control valve in which the spool is disposed at an advance angle position.

As shown in FIG. 18, in a case where the spool 232 is set at the advance angle position PA2, the hydraulic oil from the first pump port 231Pa is supplied to the advance angle port 231A through the second groove 232Gb and the hydraulic oil from the retardation angle port 231B is discharged to the drain port 231D through the third groove 232Gc. In addition, the hydraulic oil from the second pump port 231Pb is supplied to the unlock port 231L through the fourth groove 232Gd.

In this manner, the hydraulic oil from the advance angle port 231A is supplied to the advance angle chamber Ra and the hydraulic oil in the retardation angle chamber Rb is discharged from the retardation angle port 231B. At the same time, the hydraulic oil is supplied to the unlock port 231L and the lock mechanism L is unlocked. Thus, at the advance angle position PA2, the relative rotational phase is shifted in the advance angle direction S1.

Neutral Position

Figure 19:
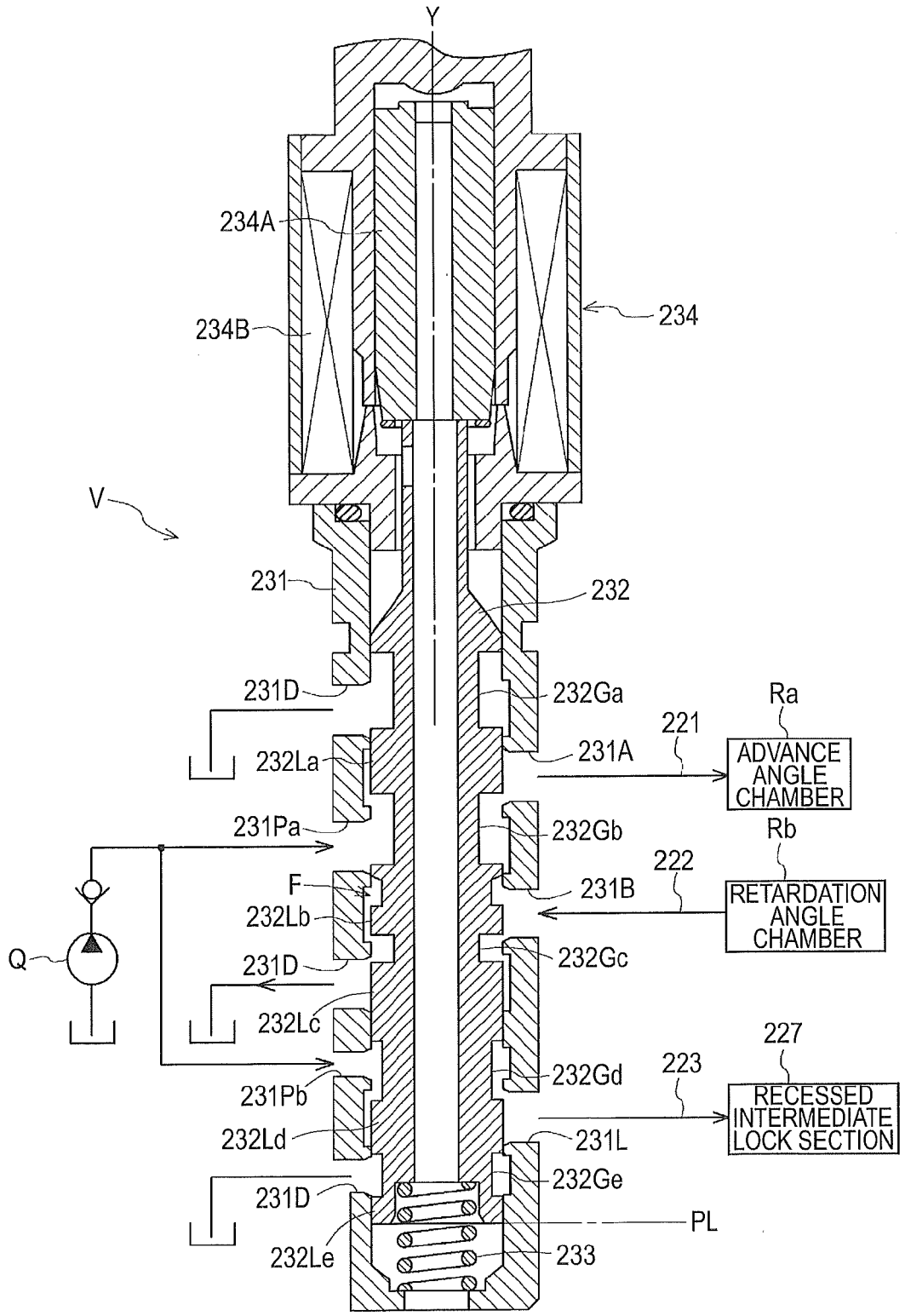
FIG. 19 is a sectional diagram showing the control valve in which the spool is disposed at a neutral position.

As shown in FIG. 19, in a case where the spool 232 is set at the neutral position PL, the advance angle port 231A is closed (is blocked) in the first land portion 232La and the retardation angle port 231B is closed (is blocked) in the second land portion 232Lb. Therefore, the hydraulic oil is supplied to neither the advance angle port 231A nor the retardation angle port 231B. In addition, the hydraulic oil from the second pump port 231Pb is supplied to the unlock port 231L through the fourth groove 232Gd.

In this manner, while the lock mechanism L is maintained in the unlocked state, the relative rotational phase in which the hydraulic oil is neither supplied to nor discharged from the advance angle chamber Ra and the retardation angle chamber Rb is maintained.

Retardation Angle Position

Figure 20:
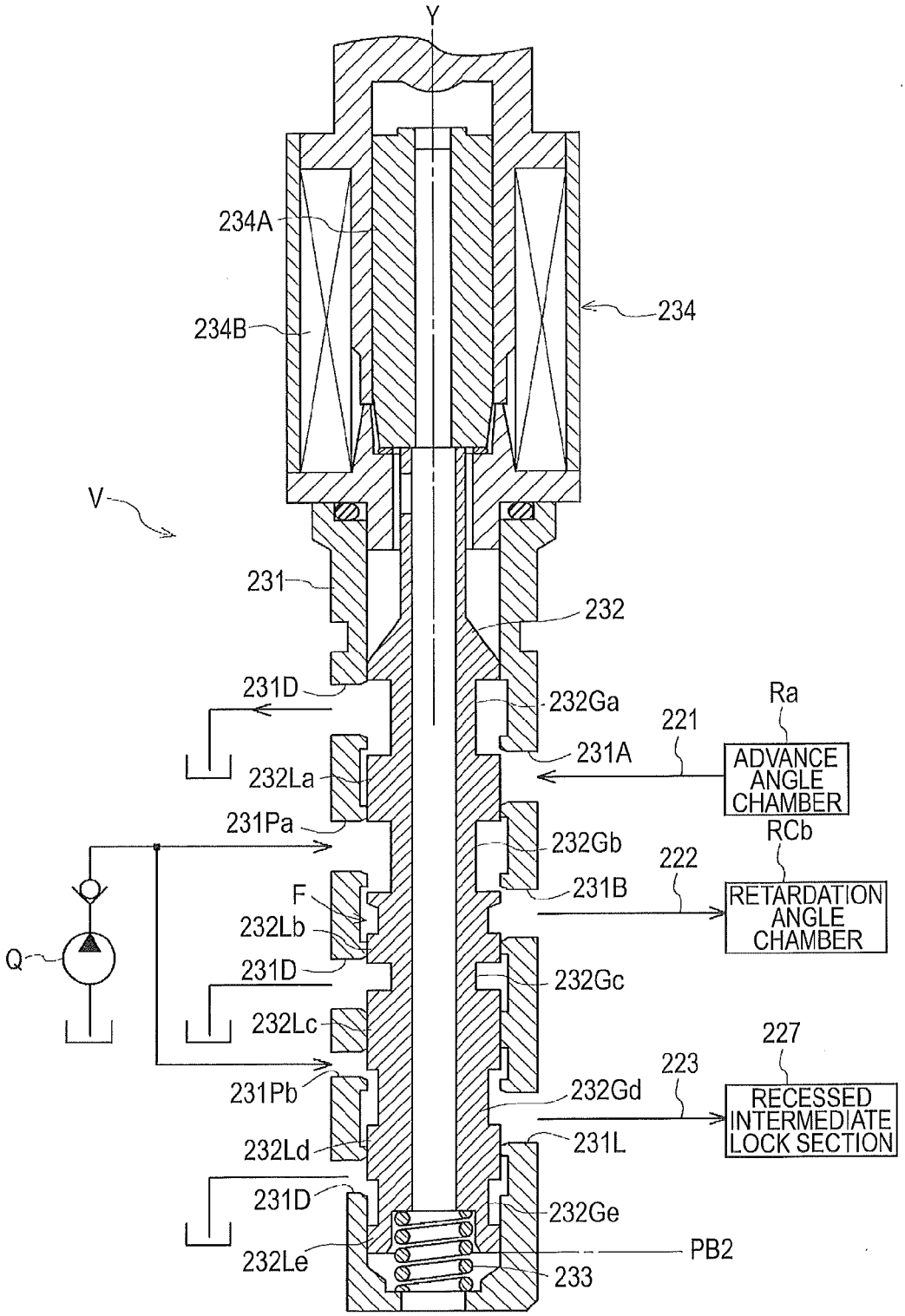
FIG. 20 is a sectional diagram showing the control valve in which the spool is disposed at a retardation angle position.

As shown in FIG. 20, in a case where the spool 232 is set at the retardation angle position PB2, the hydraulic oil from the advance angle port 231A is discharged to the drain port through the first groove 232La and the hydraulic oil from the first pump port 231Pa is supplied to the retardation angle port 231B through the second groove 232Gb. In addition, the hydraulic oil from the second pump port 231Pb is supplied to the unlock port 231L through the fourth groove 232Gd.

In this manner, the hydraulic oil from the advance angle chamber Ra is discharged from the advance angle port 231A and the hydraulic oil from the retardation angle port 231B is supplied to the retardation angle chamber Rb. In addition, the hydraulic oil is supplied to the unlock port 231L and the lock mechanism L is unlocked. Thus, at the retardation angle position PB2, the relative rotational phase is shifted in the retardation angle direction S2.

Modification Example of Control Valve

Without modifying the configuration of the embodiment described above, a configuration in which the advance angle port 231A is interchanged with the retardation angle port 231B may be employed. That is, the advance angle port 231A of the embodiment is altered to the retardation angle port and the retardation angle port 231B of the embodiment is altered to the advance angle port. That is, the operation direction of the spool 232 and the phase shift direction of the relative rotational phase are reversed, compared to a configuration in FIG. 18.

As a modification example, as shown in FIG. 22, a relationship between the supply and discharge of the hydraulic oil at the plurality of positions of the spool 232 of the control valve V is set. According to the modification example, the position of the spool 232 is set at the advance angle position PA2 in a state in which no power is supplied to the electromagnetic solenoid 234 and the spool 232 is set to be disposed at the neutral position PL, the retardation angle position PB2, and the lock start position PB1, in this order, in response to an increase of the power supplied to the electromagnetic solenoid 234.

According to the configuration of the modification example, the maximum power is supplied to the electromagnetic solenoid 234 and thereby the spool 232 is set at the lock start position PB1 and the lock mechanism L can easily enter into the locked state. Further, in a case where the spool 232 is switched from the lock start position PB1 to the retardation angle position PB2, similar to the process of switching from the lock start position PA1 to the advance angle position PA2 of the embodiment, a transition position PB1*a* appears. At the transition position PB1*a*, the hydraulic oil is supplied to the recessed intermediate lock portion 227 using the state in which the hydraulic oil is supplied to the advance angle chamber Ra and the retardation angle chamber Rb such that it is easy to unlock the locked state of the lock mechanism L.

Engine Control Unit

As shown in FIG. 11, a signal is input to the engine control unit (ECU) 240 from a shaft sensor RS, an ignition switch 243, an accelerator pedal sensor 244, a brake pedal sensor 245, and a phase detecting sensor 246. The engine control unit 240 outputs a signal to control the starter motor M, the fuel control unit 207, and the ignition control unit 208 and outputs a signal to control the control valve V.

The ignition switch 243 is configured as a switch which starts and stops the internal combustion engine control system, the engine control section 241 causes the engine E to start through an ON operation, and the engine control section 241 causes the engine E to stop through an OFF operation.

The accelerator pedal sensor 244 detects a pedaling amount of an accelerator pedal (not shown) and the brake pedal sensor 245 detects pedaling on a brake pedal (not shown).

During the operation of the engine E, the phase control section 242 controls of setting an optimum relative rotational phase by acquiring a signal from the shaft sensor RS, the accelerator pedal sensor 244, the brake pedal sensor 245, or the like and setting of an opening/closing timing of the intake valve 202 such that the phase detecting sensor 246 detects the optimum relative rotational phase.

Control Mode

Figure 25:
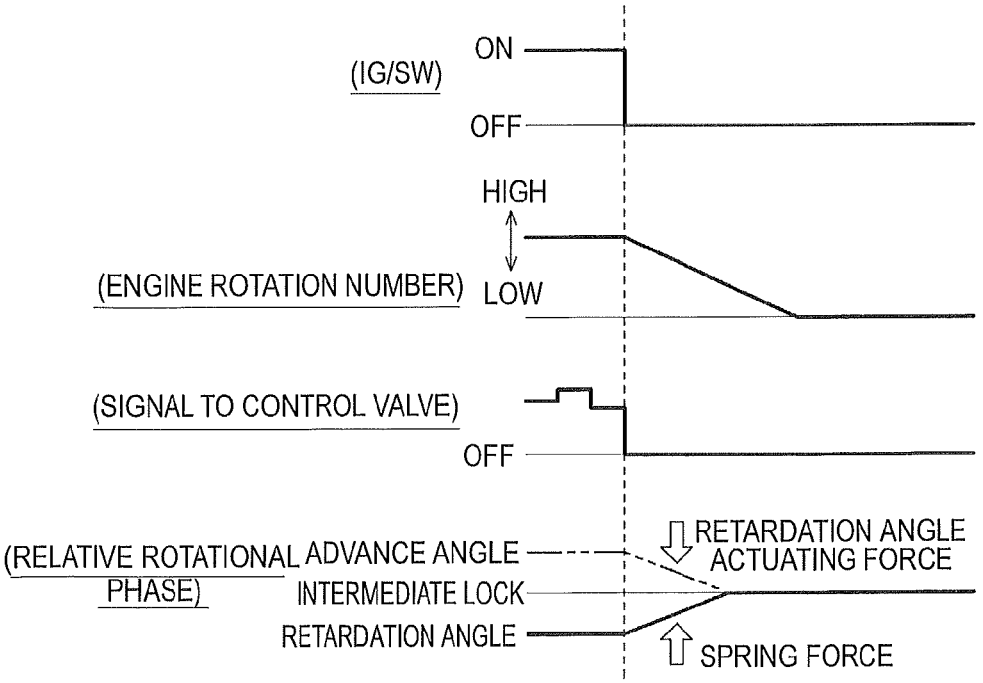
FIG. 25 is a chart showing a shift of a relative rotational phase or the like during engine stop control.

FIG. 25 shows a chart of an operation mode of each component when an operation of stopping the engine E is performed in a circumstance in which the relative rotational phase is disposed on the retardation angle side from the intermediate lock phase P. That is, the engine control section 241 performs control of stopping the engine E at a timing of the OFF operation of the ignition switch 243 (IG/SW in FIG. 25) and the phase control section 242 stops (cuts OFF) power supply to the electromagnetic solenoid 234. In this manner, the number of rotation (rotational speed) of the engine E is decreased and the relative rotational phase starts to be shifted toward the intermediate lock phase P due to the spring force (bias force) of the torsion spring 218.

In this manner, a state (OFF state) in which no power is supplied to the electromagnetic solenoid 234 is achieved and thereby, the control valve V is set at the lock start position PA1 due to the bias force of the spool spring 233. Since the crankshaft 201 of the engine E rotates even at this point, the hydraulic oil in the hydraulic pump Q is supplied to the advance angle chamber Ra and the retardation angle chamber Rb. In addition, since the hydraulic oil in the recessed intermediate lock portion 227 is discharged, the lock mechanism L enters into a state in which the locking can be performed.

As described above, in a case where the relative rotational phase is disposed on the retardation angle side from the intermediate lock phase P in the valve timing control unit 210, the spring force (bias force) of the torsion spring 218 is applied in the advance angle direction S1 as shown in FIG. 13, and no spring force (bias force) of the torsion spring 218 is applied in the advance angle direction S1 in a state in which the relative rotational phase reaches the intermediate lock phase P.

In addition, the retardation angle actuating force from the intake camshaft 206, which causes the relative rotational phase to be shifted in the retardation angle direction S2 is continuously applied to the valve timing control unit 210. However, the spring force (bias force) of the torsion spring 218 prevents the shift of the intermediate lock phase P in the retardation angle direction S2. In this reason, as shown in FIG. 14, the relative rotational phase is stably maintained in the intermediate lock phase P and it is possible for the lock mechanism L to reliably enter into the locked state.

Conversely, in a case where the operation of stopping the engine E is performed in a circumstance (circumstance shown in FIG. 15) in which the relative rotational phase is disposed on the advance angle side from the intermediate lock phase P, the relative rotational phase is shifted in the retardation angle direction S2 due to the retardation angle actuating force applied from the intake camshaft 206 as shown in a virtual line in FIG. 25. Even in this reason, the relative rotational phase is shifted to the intermediate lock phase P shown in FIG. 14 and is stably maintained in the intermediate lock phase P. Therefore, it is possible for the lock mechanism L to reliably enter into the locked state.

Thus, even in a case where the relative rotational phase of the valve timing control unit 210 is disposed on any side of the retardation angle side and the advance angle side at a timing of the OFF operation of the ignition switch 243, the relative rotational phase is shifted to the intermediate lock phase P due to the spring force of the torsion spring 218 and the retardation angle actuating force applied from the intake camshaft 206 and the locked state can be performed in the intermediate lock phase P. Particularly, since the hydraulic oil is supplied to the advance angle chamber Ra and the retardation angle chamber Rb in a case where the relative rotational phase reaches the intermediate lock phase P, the locked state is performed in a stable state without shifting the relative rotational phase in a circumstance in which the cam swinging torque is applied and vibration thereof is caused for a short time.

Modification Example of Control Mode

Figure 26:
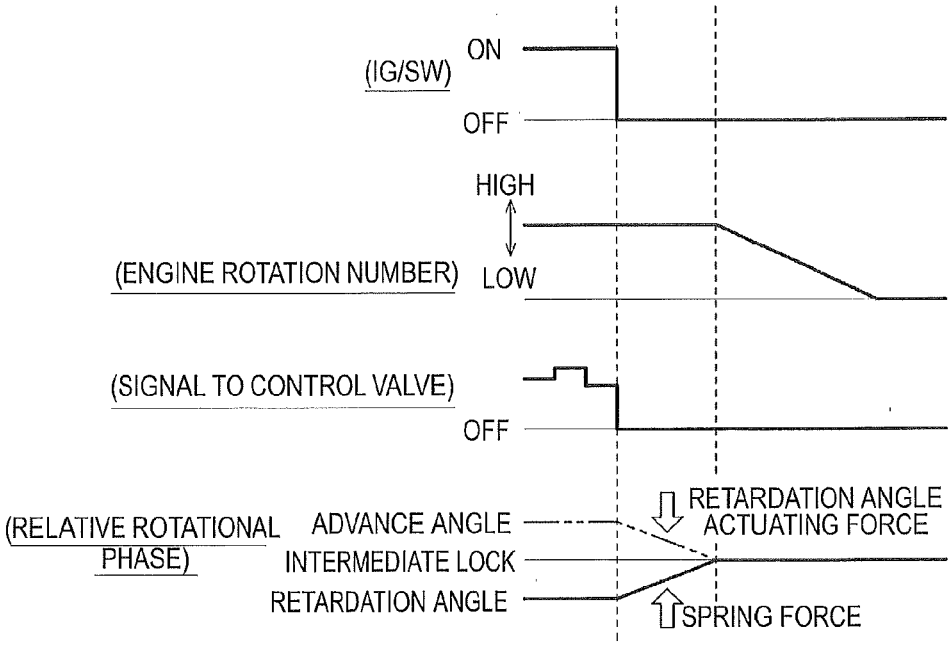
FIG. 26 is a chart showing a shift of a relative rotational phase or the like during engine stop control according to the modification example.

FIG. 26 shows an operational mode of each component when the engine E is stopped after confirming that the relative rotational phase reaches the intermediate lock phase P in a case where an operation of stopping the engine E is performed, instead of control in FIG. 25 described above.

In the control mode, the signal (power) to the electromagnetic solenoid 234 of the control valve V enters into an OFF state at a timing of the OFF operation of the ignition switch 243; however, the operation of the engine E is continued.

In this manner, the control valve V is set at the lock start position PA1 due to the bias force of the spool spring 233. At this point, since the engine E operates, a sufficient amount of the hydraulic oil from the hydraulic pump Q is supplied to the advance angle chamber Ra and the retardation angle chamber Rb, and the hydraulic oil in the recessed intermediate lock portion 227 is discharged such that the lock mechanism L enters into a state in which the locking can be performed.

In a case where the relative rotational phase is disposed on the retardation angle side from the intermediate lock phase P as shown in FIG. 13, the spring force (bias force) of the torsion spring 218 is applied in the advance angle direction S1 and the relative rotational phase reaches the intermediate lock phase P as shown in FIG. 14. In addition, in a case where the relative rotational phase is disposed on the advance angle side from the intermediate lock phase P as shown in FIG. 15, the retardation angle actuating force from the intake camshaft 206 is applied in the retardation angle direction S2 as shown in a virtual line in FIG. 26 and the relative rotational phase reaches the intermediate lock phase P as shown in FIG. 14.

In this manner, the lock mechanism L easily enters into the locked state and the engine control section 241 stops the engine E and ends the control.

According to the modification example, since the engine E operates until the relative rotational phase reaches the intermediate lock phase P, the sufficient amount of the hydraulic oil is supplied to the advance angle chamber Ra and the retardation angle chamber Rb for a short time and thereby it is possible to enter into the locked state in a state in which the shift of the relative rotational phase is smoothly controlled.

Operation Mode Performed when Engine is Started

It is possible to conceive a case in which it is not possible for the lock mechanism L to enter into the locked state even when the control described above is performed, when the engine E is stopped. Since the intermediate lock phase P means a phase in which the engine E having a cold state is caused to smoothly operate, it is desirable that the relative rotational phase reaches the intermediate lock phase P in response to the start of the engine E in a case where the lock mechanism L of the valve timing control unit 210 does not enter into the locked state. The valve timing control apparatus A of this disclosure is configured to meet such demand described above.

Figure 27:
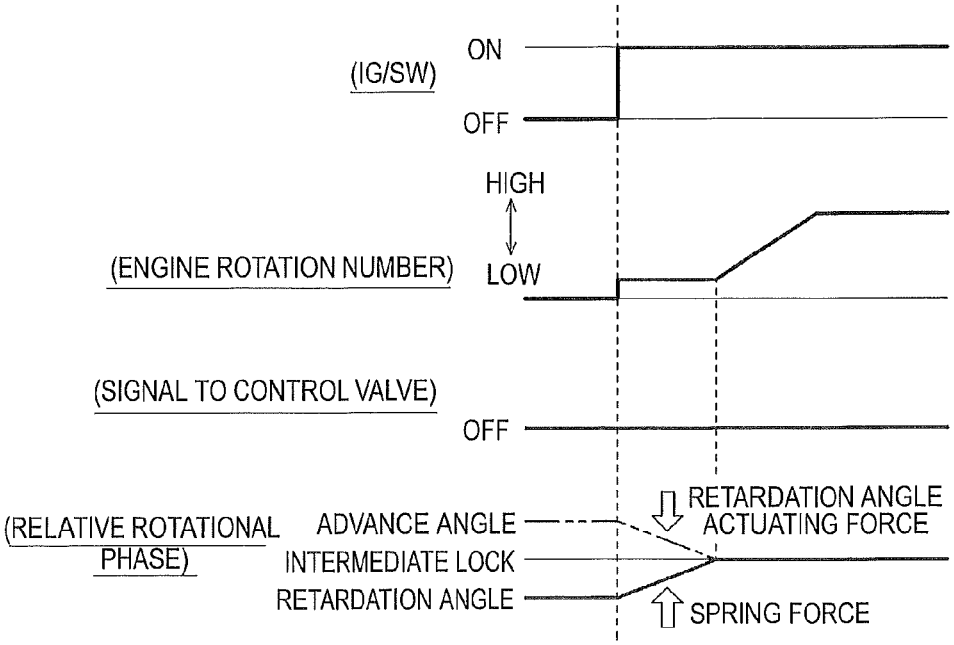
FIG. 27 is a chart showing a shift of a relative rotational phase or the like during engine start control.

That is, FIG. 27 shows a chart of a control mode of each component at the time of starting the engine E. The starter motor M is operated and the engine E starts at a timing of the ON operation of the ignition switch 243. In addition, at the time of the starting, a state (OFF state) is maintained, in which no power is supplied to the electromagnetic solenoid 234 of the control valve V.

In this manner, the hydraulic oil of the hydraulic pump Q is supplied to the advance angle chamber Ra and the retardation angle chamber Rb and the hydraulic oil in the recessed intermediate lock portion 227 is discharged such that the lock mechanism L enters into the lockable state.

During the control, in a case where the relative rotational phase is disposed on the retardation angle side from the intermediate lock phase P as shown in FIG. 13, the spring force (bias force) of the torsion spring 218 is applied in the advance angle direction S1 and the relative rotational phase reaches the intermediate lock phase P as shown in FIG. 14. In addition, in a case where the relative rotational phase is disposed on the advance angle side from the intermediate lock phase P as shown in FIG. 15, the retardation angle actuating force from the intake camshaft 206 is applied in the retardation angle direction S2 as shown in a virtual line in FIG. 26 and the relative rotational phase reaches the intermediate lock phase P as shown in FIG. 14.

In this manner, the relative rotational phase is rapidly shifted to the intermediate lock phase P and it is possible to enter into the locked state.

Switching from Lock Start Position to Advance Angle Position

When the operation mode of the control valve V after the starting of the engine E is taken into account, the first switching of the spool 232 is performed from the lock start position PA1 to the advance angle position PA2.

The control valve V according to this disclosure has a configuration in which the hydraulic oil is supplied to the recessed intermediate lock portion 227 such that the lock member 225 is caused to move and the unlocking is performed, in the process of moving from the lock start position, PA1 to the advance angle position PA2, as described above, using a mode in which the hydraulic oil is supplied to the advance angle chamber Ra and the retardation angle chamber Rb at the transition position PA1*a*.

Figure 28:
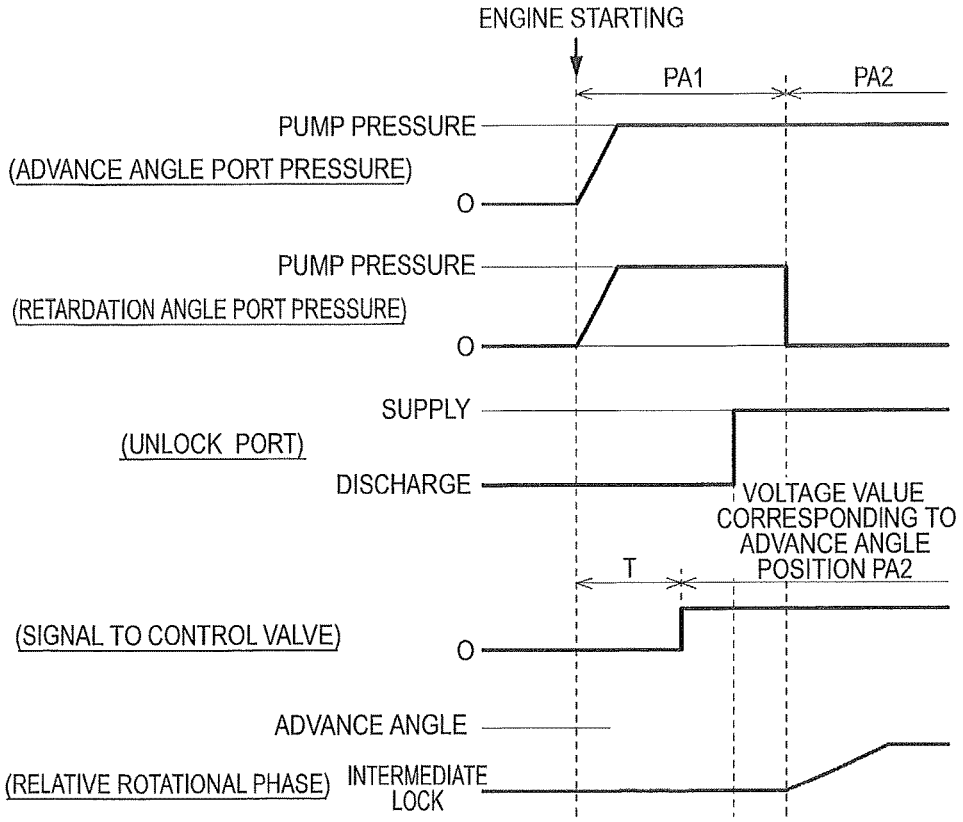
FIG. 28 is a chart showing a shift of a relative rotational phase at a transition position during engine start control.

FIG. 28 shows a chart of the operation. That is, no power is supplied to the electromagnetic solenoid 234 at the time of starting the engine E and the spool 232 of the control valve V is disposed at the lock start position PA1. The hydraulic oil is supplied to the advance angle port 231A and the retardation angle port 231B from the hydraulic pump Q in response to the starting of the engine E and an advance angle port pressure and a retardation angle port pressure are increased to a pump pressure.

A control signal to switch the spool 232 to the advance angle position PA2 is output at a timing when a set time T elapses after the start of the engine E and the spool 232 reaches the transition position PA1*a* shown in FIG. 17 after the spool 232 starts the operation. While a state of supplying the hydraulic oil from the first pump port 231Pa to the advance angle port 231A and the retardation angle port 231B is maintained at the position, the hydraulic oil from the second pump port 231Pb is supplied to the unlock port 231L through the fourth groove 232Gd.

In this manner, it is possible to separate the lock member 225 of the lock mechanism L from the recessed intermediate lock portion 227 and to perform the unlocking before the spool 232 reaches the advance angle position PA2. Then, the spool 232 reaches the advance angle position PA2 and thereby, it is possible to shift the relative rotational phase in the advance angle direction S1.

Effects of Third Embodiment

The valve timing control apparatus A according to this disclosure includes the torsion spring 218 that causes the spring force (bias force) to be applied in the region from the largest retardation angle phase to the intermediate lock phase P and the bias force in the biasing direction of the torsion is set to be higher than the retardation angle actuating force applied from the intake camshaft 206.

Therefore, in any cases where the engine E stops and the engine E starts, the spool 232 of the control valve V is set at the lock start position PA1 and thereby, the hydraulic oil is supplied to the advance angle chamber Ra and the retardation angle chamber Rb in a state in which the hydraulic oil is discharged from the unlock port 231L. Therefore, the hydraulic pressure is balanced and the shift of the relative rotational phase due to the cam swinging torque becomes small. In the state, a configuration is not employed, in which the relative rotational phase is shifted due to the pressure of the hydraulic oil but, the relative rotational phase is shifted to the intermediate lock phase P due to the spring force or the retardation angle actuating force and the lock mechanism L reliably enters into the locked state. Particularly, since the hydraulic oil is supplied to the advance angle chamber Ra and the retardation angle chamber Rb at the same time without leakage at the lock start position PA1, the advance angle chamber Ra and the retardation angle chamber Rb are rapidly filled with the hydraulic oil and it is possible to prevent the shift of the relative rotational phase.

In addition, in a case where the lock start position PA1 of the control valve V is set to a state in which power supply to the electromagnetic solenoid 234 is stopped, it is possible to prevent the relative rotational phase from fluttering and to stably perform the locked state in a state in which the relative rotational phase reaches the intermediate lock phase P, without any special control, during the control of stopping the engine E and during the control of starting the engine E.

For example, even in a case where it is not possible for the lock mechanism L to enter into the locked state when the engine E is stopped, the spool 232 of the control valve V is maintained at the lock start position PA1 when the engine E is started and thereby, it is easy to enter into the locked state after the engine E is started.

Further, in a case where the spool 232 of the control valve V is switched from the lock start position PA1 to the advance angle position PA2 after the engine E is started, it is possible to supply the hydraulic oil to the advance angle chamber Ra and the retardation angle chamber Rb in the process in which the spool 232 reaches the advance angle position PA2 and to separate the lock member 225 of the lock mechanism L from the recessed intermediate lock portion 227 in a state in which the relative rotational phase is not shifted and the smooth unlocking is realized.

Fourth Embodiment

A fourth embodiment has a configuration in which the control valve V (control valve) of the third embodiment is modified. According to the fourth embodiment, since the valve timing control unit 210 described in the third embodiment is controlled, the same reference signs are attached to the same components as the third embodiment.

As shown in FIG. 29 to FIG. 34, similar to the third embodiment, the control valve V of the fourth embodiment is also configured to include the cylindrical sleeve 231, a columnar spool 232 that is accommodated in the sleeve, the spool spring 233 that biases the spool 232 to an initial position (first retardation angle position PB1 shown in FIG. 29), and the electromagnetic solenoid 234 that causes the spool 232 to operate against the bias force of the spool spring 233.

The electromagnetic solenoid 234 is configured to have the solenoid coil 234B that is disposed on an outer periphery of the plunger 234A configured of a magnetic material such as iron. The electromagnetic solenoid 234 has a function that the more the power supply to the solenoid coil 234B is increased, the more the spool 232 is shifted against the bias force of the spool spring 233.

In a state in which no power is supplied to the electromagnetic solenoid 234, the spool 232 is positioned at the first retardation angle position PB1 (initial position: the first position). The spool 232 is configured to be disposed through operation at the second retardation angle position PB2, the neutral position PL, the second advance angle position PA2, the first advance angle position PA1, and an oil filling position PA0 as the second position, in this order, in response to an increase of the power supplied to the electromagnetic solenoid 234. In addition, FIG. 35 shows a relationship between the supply and discharge of the hydraulic oil at the positions.

In the sleeve 231, the advance angle port 231A that communicates with the advance angle flow path 221, the retardation angle port 231B that communicates with the retardation angle flow path 222, the unlock port 231L that causes the unlocking pressure to act on the lock member 225 by communicating with the unlock flow path 223 are formed. In addition, in the sleeve 231, the first pump port 231Pa to which the hydraulic oil is supplied from the hydraulic pump Q, the second pump port 231Pb, and the three drain ports 231D are formed.

In the spool 232, the first land portion 232La for controlling the hydraulic oil, the second land portion 232Lb, the third land portion 232Lc, the fourth land portion 232Ld, and the fifth land portion 232Le are formed. In addition, the first groove 232La is formed on the electromagnetic solenoid 234 side from the first land portion 232La and the second groove 232Gb is formed between the first land portion 232La and the second land portion 232Lb. The third groove 232Gc, the fourth groove 232Gd, and the fifth groove 232Ge are formed at positions in accordance with the above description. The plurality of land portions and the plurality of grooves have the same functions as in the third embodiment during the operation of the spool 232.

In addition, a first divergence portion F1 is formed between the outer periphery of the first land portion 232La and the inner periphery of the sleeve 231 and a second divergence portion F2 is formed between the outer periphery of the fourth land portion 232Ld and the inner periphery of the sleeve 231.

The control valve V is configured such that the spool 232 further moves after the spool 232 moves from the second advance angle position PA2 to the first advance angle position PA1 and thereby, the spool 232 reaches the oil filling position PA0.

Operational Mode

Figure 29:
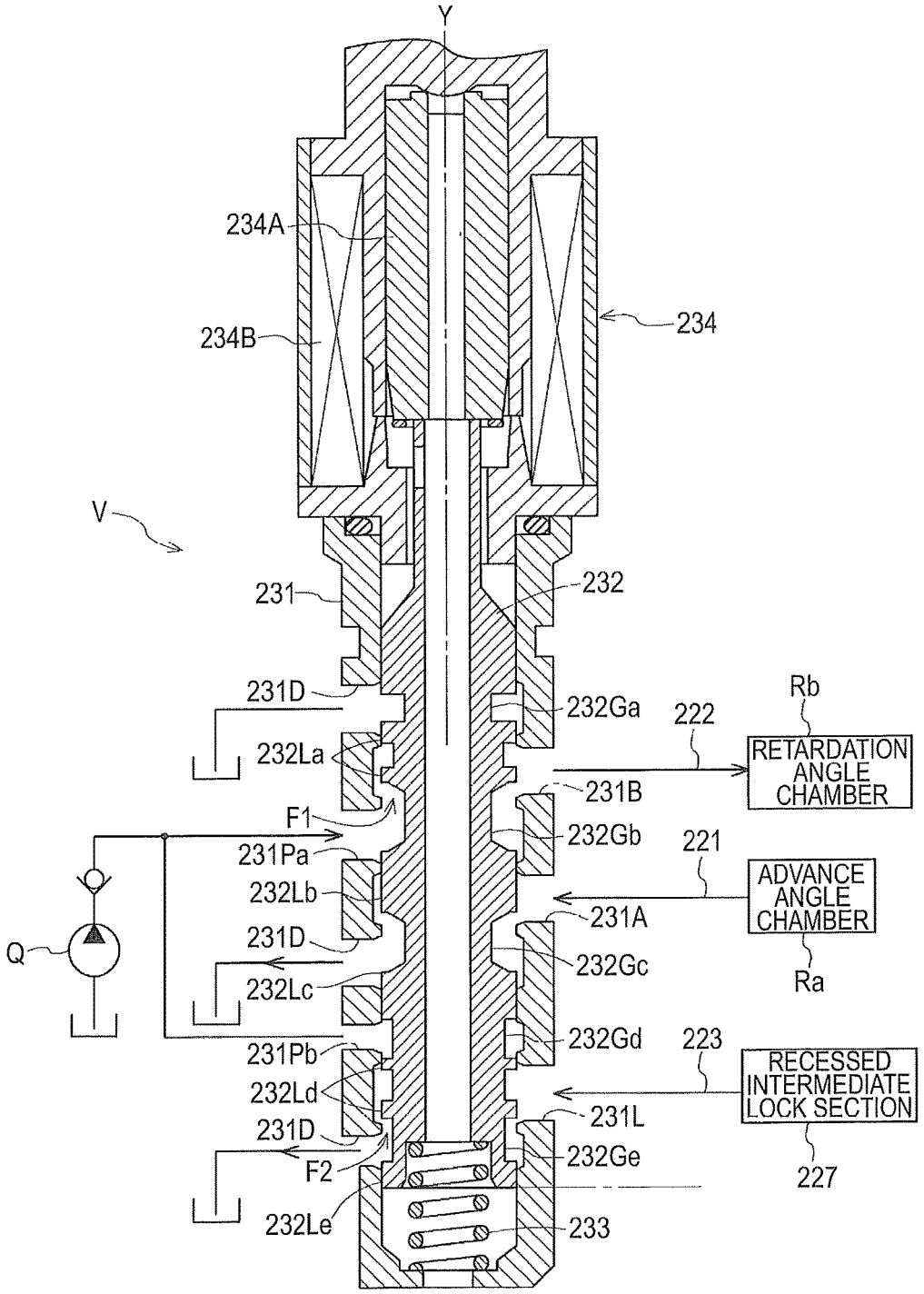
FIG. 29 is a sectional diagram showing a control valve in which a spool is disposed at a first retardation angle position according to a fourth embodiment.

Thus, as shown in FIG. 29, in a case where the spool 232 is set at the first retardation angle position PB1, the hydraulic oil is discharged from the advance angle chamber Ra and, at the same time, the hydraulic oil is supplied to the retardation angle chamber Rb. In addition, the hydraulic oil is discharged from the recessed intermediate lock portion 227 and thereby, the relative rotational phase is shifted in the retardation angle direction S2 and the lock mechanism L (an example of the intermediate lock mechanism) enters into the locked state in a case where the relative rotational phase reaches the intermediate lock phase.

Figure 30:
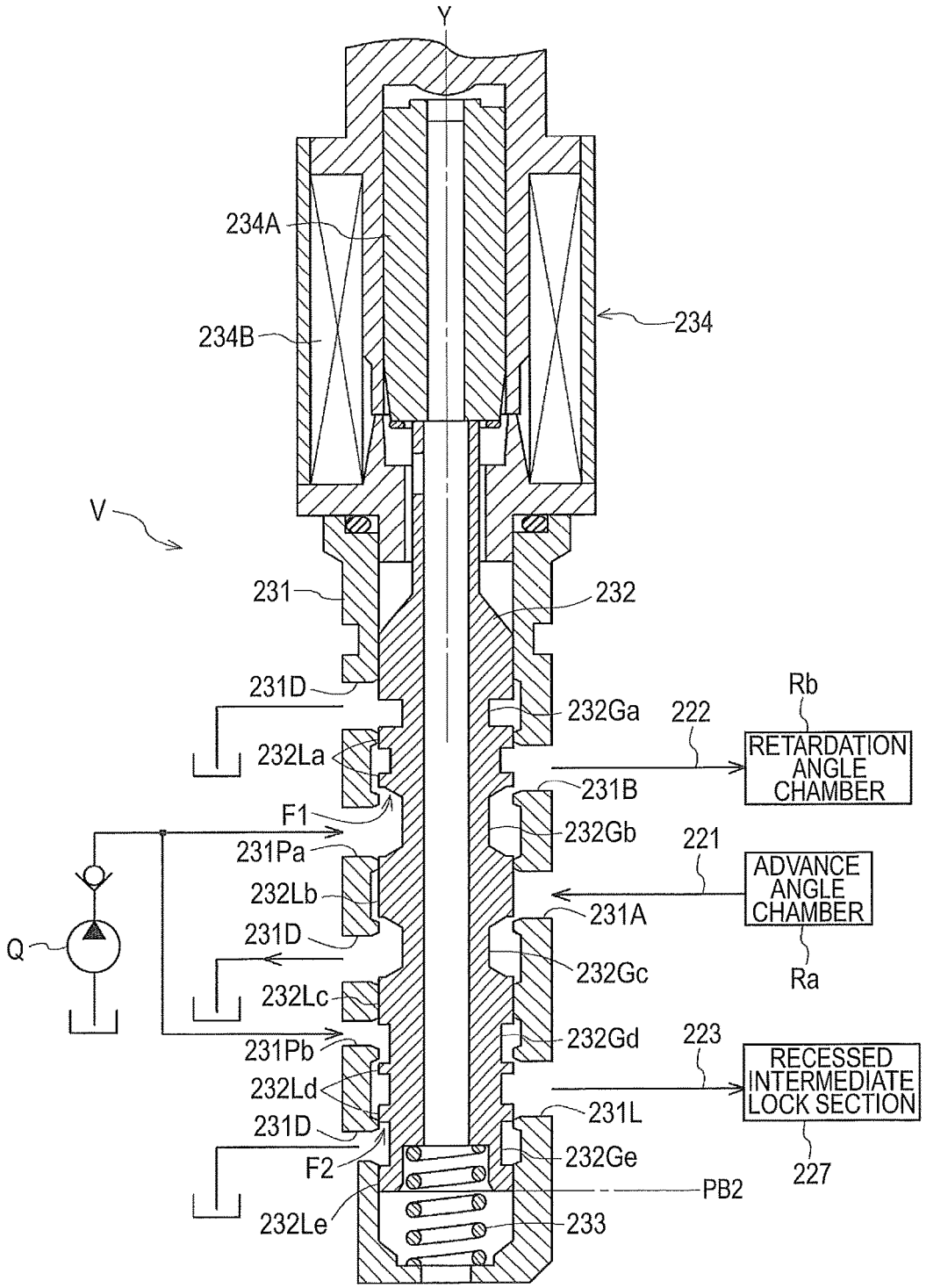
FIG. 30 is a sectional diagram showing the control valve in which the spool is disposed at a second retardation angle position.

Next, as shown in FIG. 30, in a case where the spool 232 moves from the first retardation angle position PB1 to the second retardation angle position PB2, while a state of discharging the hydraulic oil from the advance angle chamber Ra and supplying the hydraulic oil to the retardation angle chamber Rb is maintained, the hydraulic oil is supplied to the recessed intermediate lock portion 227 and thereby, the lock mechanism L starts to be unlocked. In this manner, the relative rotational phase is shifted in the retardation angle direction.

Figure 31:
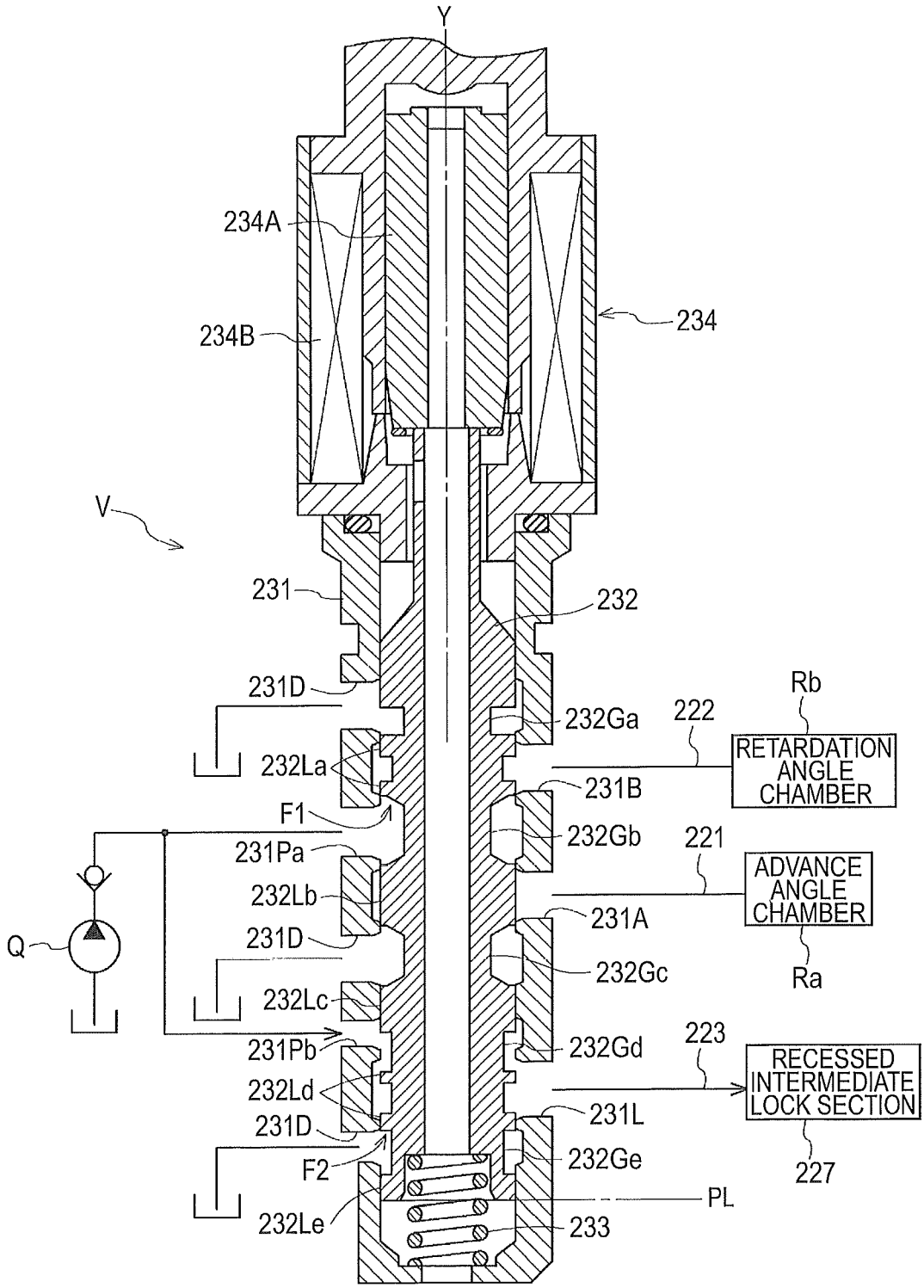
FIG. 31 is a sectional diagram showing the control valve in which the spool is disposed at a neutral position.

Next, as shown in FIG. 31, in a case where the spool 232 is operated to be disposed at the neutral position PL, the advance angle port 231A is closed (is blocked) in the second land portion 232Lb and the retardation angle port 231B is closed (is blocked) in the first land portion 232La. Therefore, the hydraulic oil is supplied to neither the advance angle chamber Ra nor the retardation angle chamber Rb. Since the hydraulic oil from the second pump port 231Pb is supplied to the unlock port 231L through the fourth groove 232Gd at the neutral position PL, the locked state of the lock mechanism L is unlocked.

Figure 32:
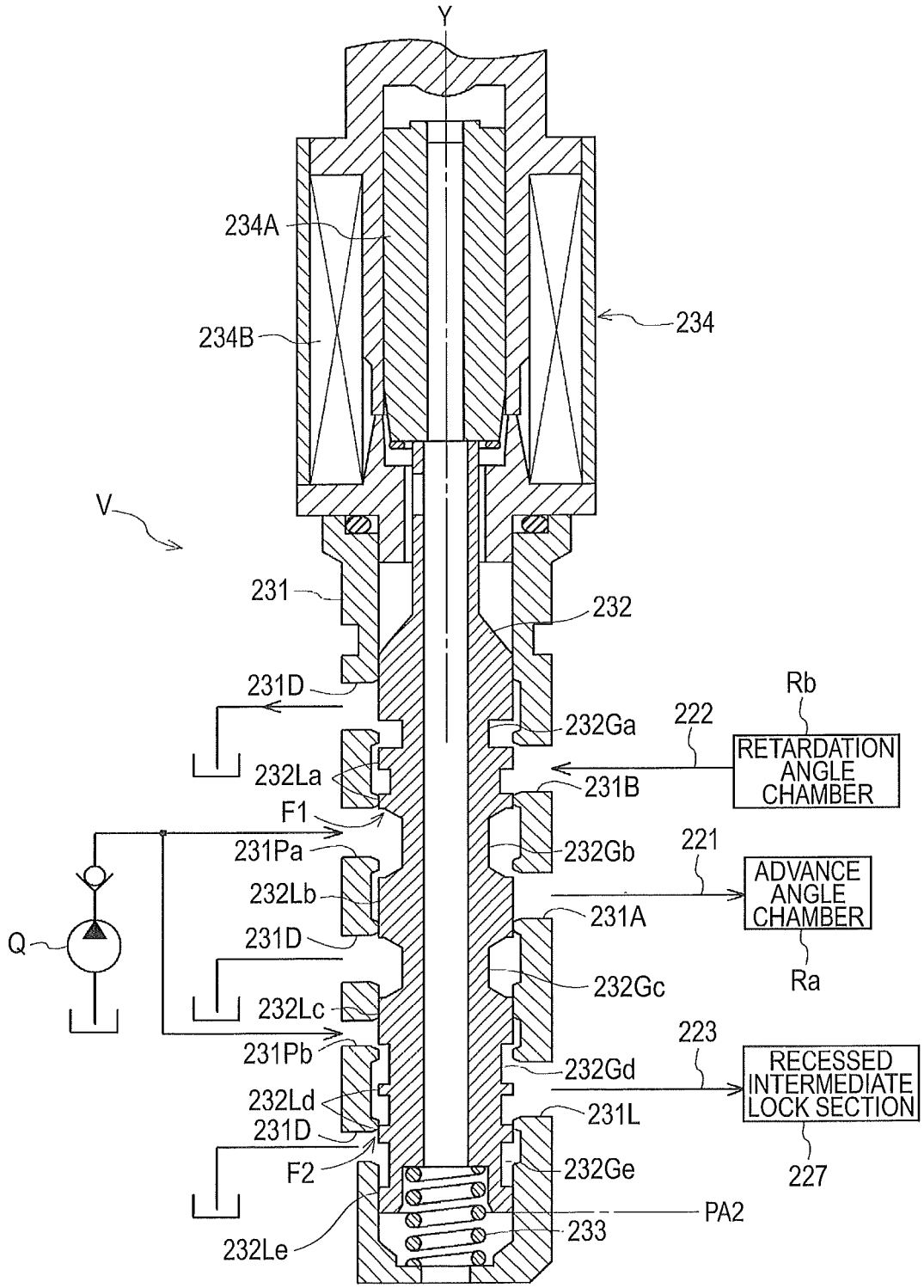
FIG. 32 is a sectional diagram showing the control valve in which the spool is disposed at a second advance angle position.

In addition, as shown in FIG. 32, in a case where the spool 232 is set at the second advance angle position PA2, the hydraulic oil is supplied to the advance angle chamber Ra and, at the same time, the hydraulic oil is discharged from the retardation angle chamber Rb. Since the hydraulic oil is supplied to the recessed intermediate lock portion 227 at the second advance angle position PA2, the locked state of the lock mechanism L is unlocked and the relative rotational phase is shifted in the advance angle direction S1.

Figure 33:
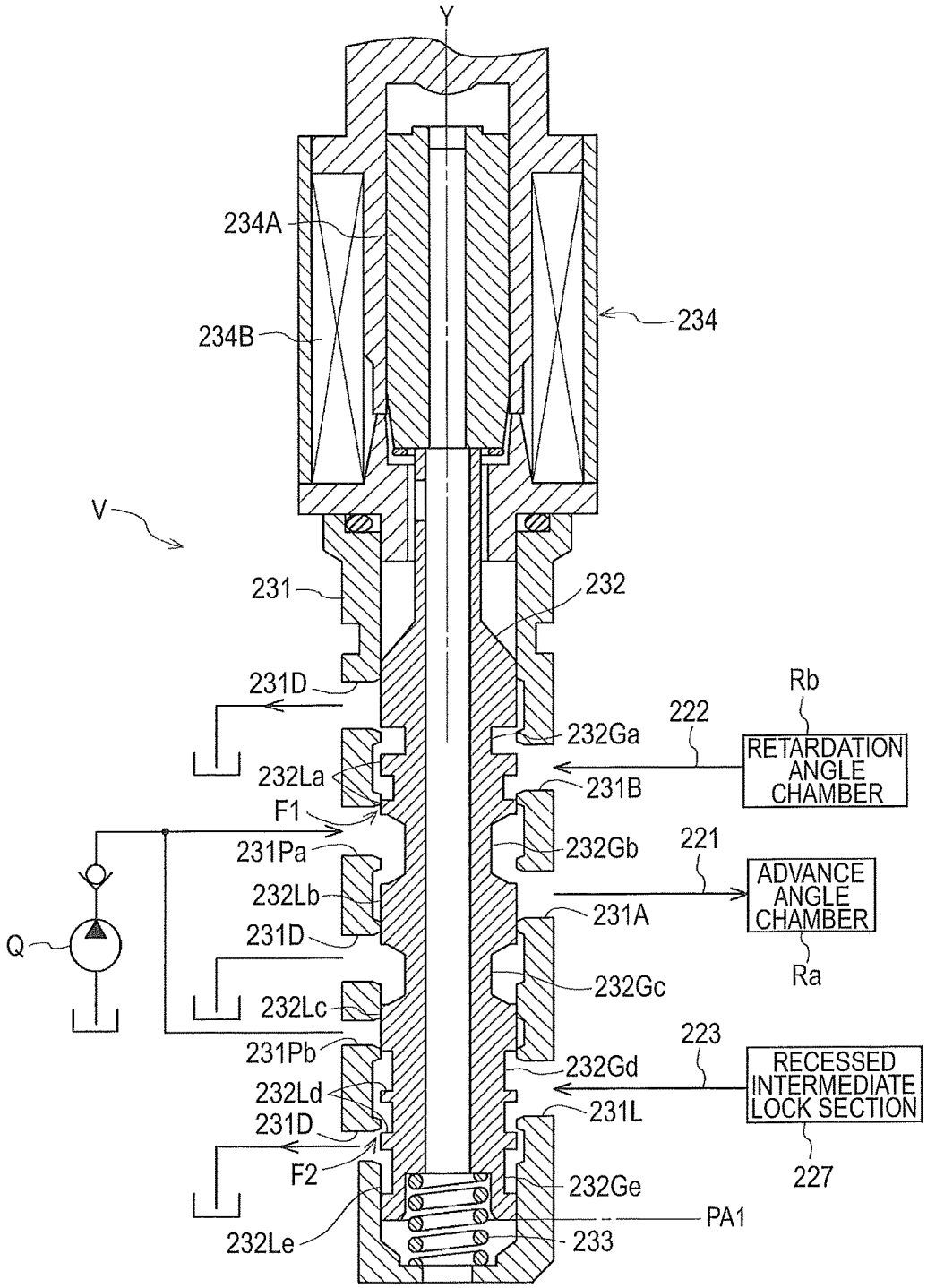
FIG. 33 is a sectional diagram showing the control valve in which the spool is disposed at a first advance angle position.

Next, as shown in FIG. 33, in a case where the spool 232 is operated to move from the second advance angle position PA2 to the first advance angle position PA1, while a state of supplying the hydraulic oil to the advance angle chamber Ra and discharging the hydraulic oil from the retardation angle chamber Rb is maintained, the hydraulic oil is discharged from the recessed intermediate lock portion 227. In this manner, the lock mechanism L enters into the locked state in a case where the relative rotational phase reaches the lock phase.

Figure 34:
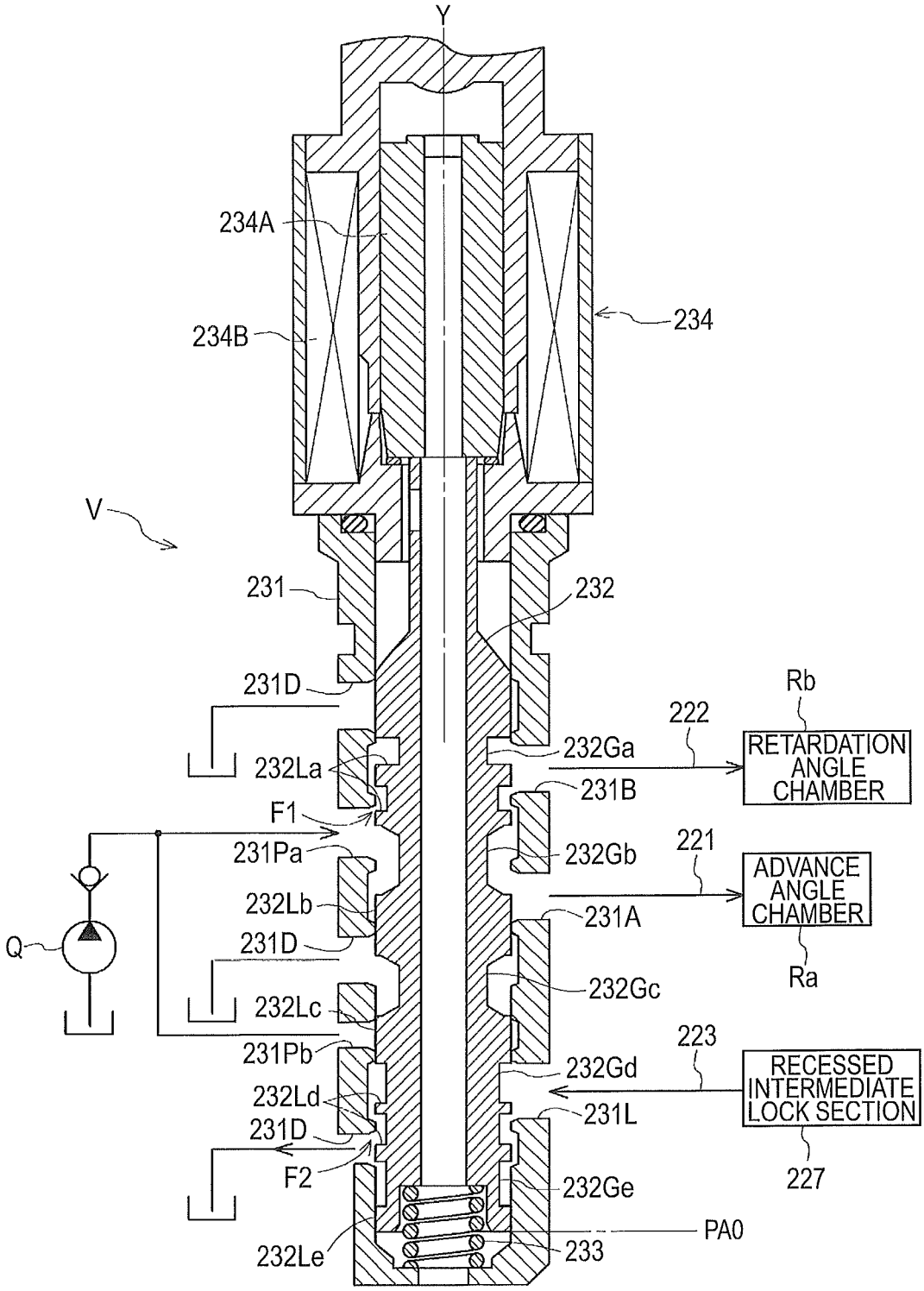
FIG. 34 is a sectional diagram showing the control valve in which the spool is disposed at an advance angle maintaining position.

In addition, as shown in FIG. 34, the spool 232 is further operated after the spool 232 reaches the first advance angle position PA1 and thereby the spool 232 reaches the oil filling position PA0. At the oil filling position PA0, the hydraulic oil is supplied to the advance angle chamber Ra and the retardation angle chamber Rb at the same time, and the hydraulic oil is discharged from the recessed intermediate lock portion 227.

As specific flowing of the hydraulic oil, in a case where the spool 232 moves to the oil filling position PA0, the hydraulic oil from the first pump port 231Pa is supplied from the retardation angle port 231B to the retardation angle chamber Rb through supplied the first divergence portion F1 and supplies the hydraulic oil from the first pump port 231Pa to the advance angle chamber Ra from the second groove 232Gb and from the advance angle port 231A. In addition, the second divergence portion F2 discharges the hydraulic oil flowing from the recessed intermediate lock portion 227 to the unlock port 231L to the drain port 231D.

For example, when switching from a state in which the second retardation angle position PB2 is unlocked to the locked state, the supply of the hydraulic oil to the recessed intermediate lock portion 227 is stopped and the hydraulic oil is supplied only to the advance angle chamber Ra and is discharged from the retardation angle chamber Rb, before the spool 232 reaches the first advance angle position PA1. In the configuration, it is possible to shift the relative rotational phase due to differential pressure produced between the advance angle chamber Ra and the retardation angle chamber Rb and it is possible for the lock mechanism L to reliably enter into the locked state.

Effects of Fourth Embodiment

The spool 232 of the control valve V is set at the oil filling position PA0 in the case of starting the engine E and thereby, the hydraulic oil is supplied to the advance angle chamber Ra and the retardation angle chamber Rb at the same time in a state in which the hydraulic oil is discharged from the recessed intermediate lock portion 227. Therefore, it is possible to rapidly fill the advance angle chamber Ra and the retardation angle chamber Rb with the hydraulic oil and it is possible to rapidly start the operation of the valve timing control apparatus.

Other Embodiments

This disclosure may have the following configurations, other than the embodiments described above.

(a) As shown in FIG. 36, the supply and discharge of the hydraulic oil are set at the plurality of positions of the spool 232 of the control valve V. In the other embodiment (a), the spool 232 is disposed at the lock start position PA1 in a state in which no power is supplied to the electromagnetic solenoid 234. The spool 232 is set at the advance angle position PA2, the neutral position PL, the retardation angle position PB2, and a retardation angle side lock position PB0, in this order, in response to an increase of the power supplied to the electromagnetic solenoid 234.

According to the other embodiment (a), the lock start position PA1, the advance angle position PA2, the neutral position PL, and the retardation angle position PB2 are common with the embodiment and the retardation angle side lock position PB0 means a position at which the relative rotational phase is shifted in the retardation angle direction S2 and it is possible for the lock mechanism L to enter into the locked state.

The other embodiment (a) also has a configuration in which a state of supplying the hydraulic oil to the advance angle chamber Ra and the retardation angle chamber Rb by forming the transition position in the process from the lock start position PA1 to the advance angle position PA2 of the control valve V of the embodiment is maintained and the hydraulic oil is supplied to the recessed intermediate lock portion 227.

The other embodiment (a) may also employ a configuration in which switching between the advance angle port 231A and the retardation angle port 231B is performed without changing the configuration of the control valve V. In addition, in the configuration, only the lock start position PA1 may be formed on the functioning end of the spool 232 and the transition position may not be formed.

(b) As shown in FIG. 37, the supply and discharge of the hydraulic oil at the plurality of positions of the spool 232 of the control valve V are set. In the other embodiment (b), partially similar to the positions of the other embodiment (a) described above, the spool 232 is disposed at the lock start position PA1 in a state in which no power is supplied to the electromagnetic solenoid 234. The maximum power is supplied to the electromagnetic solenoid 234 and thereby, the spool 232 is set at the lock start position PB1. In this configuration, the lock mechanism L easily enters into the locked state at both the lock start positions PA1 and PB1.

The other embodiment (b) also has a configuration in which a state of supplying the hydraulic oil to the advance angle chamber Ra and the retardation angle chamber Rb by forming the transition position in the process from the lock start position PB1 to the retardation angle position PB2 of the control valve V of the embodiment is maintained and the hydraulic oil is supplied to the recessed intermediate lock portion 227.

The other embodiment (b) may also employ a configuration in which switching between the advance angle port 231A and the retardation angle port 231B is performed without changing the configuration of the control valve V. In addition, in the configuration, only the lock start position PB1 may be formed on the functioning end of the spool 232 and the transition position may not be formed.

(c) As the phase setting mechanism, a ratchet mechanism may be configured to shift the relative rotational phase in a direction against the reactive force from the camshaft in a region in which the lock phase is reached from the largest retardation angle phase or the largest advance angle phase.

(d) As the phase setting mechanism, an assist-only oil chamber may be separately formed to shift the relative rotational phase in a direction against the reactive force from the camshaft and may be configured to supply the hydraulic oil to the oil chamber and thereby, to cause the relative rotational phase to move to the intermediate lock phase P. In the case of such a configuration, an accumulator that enables the hydraulic oil to be supplied to the oil chamber during the stop of the engine E may be provided.

(e) In a case where a spring is used as the phase setting mechanism, the spring is not limited to the torsion spring, but a compression coil spring or a tension coil spring may be used and rubber or a gas spring may be used instead of the spring.

(f) As the phase setting mechanism, a control mode of the engine control unit 240 may be set to perform control of supplying the hydraulic oil to the advance angle flow path 221 and the retardation angle flow path 222 based on the relative rotational phase immediately before the spool 232 is set at the lock start position.

The control mode is set as in the other embodiment (f) and thereby, the relative rotational phase can be shifted toward the intermediate lock phase P and it is possible to easily enter into the locked state.

(g) As the phase setting mechanism, a flow path structure may be provided, in which a flow rate difference is generated between the hydraulic oil which is supplied to the advance angle flow path 221 and the hydraulic oil which is supplied to the retardation angle flow path 222 in a case where the spool 232 is set at the lock start position. The flow path structure may be realized through setting a sectional area of the flow path but the control valve V may be provided such that the hydraulic oil is controlled when the spool 232 is disposed at the lock start position.

According to the configuration as in the other embodiment (g), it is possible to shift the relative rotational phase toward the lock phase.

(h) As the phase setting mechanism, a configuration may be provided, in which the hydraulic oil from one of the advance angle flow path 221 and the retardation angle flow path 222 slightly leaks to the drain flow path at the lock start position. A configuration may be employed, in which the hydraulic oil in one flow path is discharged to the drain flow path through an orifice or the control valve V may have the configuration such that the hydraulic oil is discharged to the drain flow path in the spool 232 at the lock start position.

According to the configuration as in the other embodiment (h), it is possible to easily shift the relative rotational phase toward the lock phase.

(i) According to the embodiment in FIG. 4, the hydraulic oil in the first recessed portion 85 and the second recessed portion 86 is discharged through the unlock flow path 45; however, the configuration is not limited thereto. For example, the hydraulic oil in the first recessed portion 85 and the second recessed portion 86 may be discharged through the locking discharge flow path 46 in a state in which the unlock flow path 45 is closed. Alternatively, the hydraulic oil in the first recessed portion 85 and the second recessed portion 86 may be discharged through both the unlock flow path 45 and the locking discharge flow path 46.

An aspect of this disclosure is directed to a valve timing control apparatus including: a drive-side rotational member that synchronously rotates with a drive shaft of an internal combustion engine; a driven-side rotational member that is disposed inside the drive-side rotational member to be coaxial to the drive-side rotational member and that integrally rotates with a valve opening/closing camshaft of the internal combustion engine; a hydrostatic pressure chamber that is formed by partitioning a space between the drive-side rotational member and the driven-side rotational member; an advance angle chamber and a retardation angle chamber that are formed by dividing the hydrostatic pressure chamber with a dividing section provided on at least one of the drive-side rotational member and the driven-side rotational member; an intermediate lock mechanism that is able to selectively switch, through supplying and discharging of a hydraulic fluid, between a locked state in which a relative rotational phase of the driven-side rotational member to the drive-side rotational member is restricted to an intermediate lock phase between the largest advance angle phase and the largest retardation angle phase and an unlocked state in which the restriction to the intermediate lock phase is released; an advance angle flow path that allows the hydraulic fluid which is supplied to and discharged from the advance angle chamber to be circulated; a retardation angle flow path that allows the hydraulic fluid which is supplied to and discharged from the retardation angle chamber to be circulated; a control valve that has a spool which moves between a first position in a case where a power supply amount is zero and a second position different from the first position in a case of power supply; and a phase control unit that controls the control valve by controlling a power supply amount to the control valve and that supplies a hydraulic fluid to the advance angle chamber and the retardation angle chamber to shift the relative rotational phase. When the spool is disposed at one of the first position and the second position, the hydraulic fluid is set to be supplied to both the advance angle chamber and the retardation angle chamber.

In this configuration, when the internal combustion engine is started, it is possible to supply the hydraulic fluid to both the advance angle chamber and the retardation angle chamber and to fill the chambers in an early stage such that the operation of the valve timing control apparatus is rapidly started.

In the aspect of this disclosure, a hydraulic fluid may be supplied to one of the advance angle flow path or the retardation angle flow path before the spool reaches the second position from the first position.

In this configuration, it is easy to shift the relative rotational phase at any direction between the advance angle direction and the retardation angle direction.

In the aspect of this disclosure, when the spool is disposed at one of the first position and the second position, the intermediate lock mechanism may enter into a locked state and the hydraulic fluid may be supplied to one of the advance angle chamber and the retardation angle chamber and may be discharged from the other chamber, and when the spool is disposed at the other position of the first position and the second position, the intermediate lock mechanism may enter into a locked state and the hydraulic fluid may be supplied to both the advance angle chamber and the retardation angle chamber.

In this configuration, in a case where the spool is disposed at one of the first position and the second position, the intermediate lock mechanism enters into the locked state and the hydraulic fluid is supplied to one of the advance angle chamber and the retardation angle chamber. In addition, in a case where the spool is disposed at the other position of the first position and the second position, the intermediate lock mechanism enters into the locked state and the hydraulic fluid is supplied to both the advance angle chamber and the retardation angle chamber.

In the aspect of this disclosure, when the spool is disposed at one of the first position and the second position, the advance angle chamber and the retardation angle chamber may communicate with each other through a communication path formed in the spool such that a part of the hydraulic fluid is supplied to one of the advance angle chamber and the retardation angle chamber and a part of the hydraulic fluid is supplied to the other chamber through the communication path.

The spool is disposed at the first position or the second position and thereby, for example, a part of the hydraulic fluid is supplied to the advance angle chamber and a part of the hydraulic fluid is supplied to the retardation angle chamber through the communication path. In this manner, when the internal combustion engine is started, it is possible to fill the advance angle chamber and the retardation angle chamber with the hydraulic fluid at an early stage and it is possible to rapidly start the operation of the valve timing control apparatus immediately after the internal combustion engine is started.

In the aspect of this disclosure, the valve timing control apparatus may further include a phase setting mechanism that shifts the relative rotational phase to the intermediate lock phase. When the spool is disposed at one of the first position and the second position, the phase setting mechanism may have a flow path allowing a part of a hydraulic fluid to flow out from one of the advance angle flow path and the retardation angle flow path.

For example, the intermediate lock mechanism does not enter into the locked state when the internal combustion engine is stopped and the relative rotational phase is maintained at the retardation angle. Even in such a state, at the next starting, the spool is disposed at the first position or the second position and thereby, the hydraulic fluid flows out from the retardation angle flow path such that it is easy to shift the relative rotational phase to the advance angle direction and to cause the intermediate lock mechanism to enter into the locked state.

In the aspect of this disclosure, the valve timing control apparatus may further include a phase setting mechanism that shifts the relative rotational phase to the intermediate lock phase. When the spool is disposed at one of the first position and the second position, the phase setting mechanism may have a flow path structure in which a flowing amount of a hydraulic fluid which is supplied to the advance angle flow path is caused to be different from a flowing amount of a hydraulic fluid which is supplied to the retardation angle flow path.

For example, the intermediate lock mechanism does not enter into the locked state when the internal combustion engine is stopped and the relative rotational phase is maintained at the retardation angle. Even in such a state, at the next starting, the spool is disposed at the first position or the second position and thereby, the relative rotational phase is shifted to the advance angle direction due to the difference in the flow rates of the hydraulic fluid such that the intermediate lock mechanism easily enters into the locked state.

In the aspect of this disclosure, the valve timing control apparatus may further include a phase setting mechanism that shifts the relative rotational phase to the intermediate lock phase. The phase setting mechanism may be provided with a spring that has a bias force which exceeds, in size, average torque calculated by fluctuating torque of the camshaft and that causes the bias force to act on shifting the relative rotational phase from the largest retardation angle phase to the intermediate lock phase.

In this configuration, when the internal combustion engine is stopped and started, the hydraulic fluid is not sufficiently supplied to the advance angle chamber and the retardation angle chamber. Even in a case where the intermediate lock mechanism does not enter into the locked state, the relative rotational phase is likely to be shifted to the lock phase by a reactive force from the camshaft and a bias force of the spring. Thus, since the relative rotational phase is set substantially to the intermediate phase when the internal combustion engine is stopped, the next start of the internal combustion engine is stable.

This disclosure can be applied to a valve timing control apparatus that controls a relative rotational phase of a driven-side rotational member to a drive-side rotational member which is synchronized with and rotates with a crankshaft of an internal combustion engine.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing control apparatus comprising:

a drive-side rotational member that synchronously rotates with a drive shaft of an internal combustion engine;

a driven-side rotational member that is disposed inside the drive-side rotational member to be coaxial to the drive-side rotational member and that integrally rotates with a valve opening/closing camshaft of the internal combustion engine;

a hydrostatic pressure chamber that is formed by partitioning a space between the drive-side rotational member and the driven-side rotational member;

an advance angle chamber and a retardation angle chamber that are formed by dividing the hydrostatic pressure chamber with a dividing section provided on at least one of the drive-side rotational member and the driven-side rotational member;

an intermediate lock mechanism that is able to selectively switch, through supplying and discharging of a hydraulic fluid, between a locked state in which a relative rotational phase of the driven-side rotational member to the drive-side rotational member is restricted to an intermediate lock phase between the largest advance angle phase and the largest retardation angle phase and an unlocked state in which the restriction to the intermediate lock phase is released;

a phase setting mechanism that shifts the relative rotational phase to the intermediate lock phase;

an advance angle flow path that allows the hydraulic fluid which is supplied to and discharged from the advance angle chamber to be circulated;

a retardation angle flow path that allows the hydraulic fluid which is supplied to and discharged from the retardation angle chamber to be circulated;

a control valve that has a spool which moves between a first position in a case where a power supply amount is zero and a second position different from the first position in a case of power supply; and a phase control unit that controls the control valve by controlling a power supply amount to the control valve and that supplies a hydraulic fluid to the advance angle chamber and the retardation angle chamber to shift the relative rotational phase, wherein, when the spool is disposed at one of the first position and the second position, the hydraulic fluid is set to be supplied to both the advance angle chamber and the retardation angle chamber, wherein, when the spool is disposed at the other of the first position and the second position, the hydraulic fluid is discharged from the intermediate lock mechanism and the hydraulic fluid is supplied to one of the advance angle chamber and the retardation angle chamber and is discharged from the other chamber, and wherein, when the spool is disposed at the one of the first position and the second position, the hydraulic fluid is discharged from the intermediate lock mechanism and the hydraulic fluid is supplied to both the advance angle chamber and the retardation angle chamber, wherein the phase setting mechanism is provided with a spring that has a bias force which exceeds, in magnitude, average torque calculated by fluctuating torque of the camshaft and that causes the bias force to act on shifting the relative rotational phase from the largest retardation angle phase to the intermediate lock phase.

2. The valve timing control apparatus according to claim 1, wherein a hydraulic fluid is supplied to one of the advance angle flow path or the retardation angle flow path before the spool reaches the second position from the first position.

3. The valve timing control apparatus according to claim 2, wherein, when the spool is disposed at the one of the first position and the second position, the advance angle chamber and the retardation angle chamber communicate with each other through a communication path formed in the spool such that a part of the hydraulic fluid is supplied to one of the advance angle chamber and the retardation angle chamber and a part of the hydraulic fluid is supplied to the other chamber through the communication path.

4. The valve timing control apparatus according to claim 2, wherein, when the spool is disposed at the one of the first position and the second position, the phase setting mechanism has a flow path allowing a part of a hydraulic fluid to flow out from one of the advance angle flow path and the retardation angle flow path.

5. The valve timing control apparatus according to claim 2, wherein, when the spool is disposed at the one of the first position and the second position, the phase setting mechanism has a flow path structure in which a flowing amount of a hydraulic fluid which is supplied to the advance angle flow path is caused to be different from a flowing amount of a hydraulic fluid which is supplied to the retardation angle flow path.

6. The valve timing control apparatus according to claim 1, wherein, when the spool is disposed at the one of the first position and the second position, the advance angle chamber and the retardation angle chamber communicate with each other through a communication path formed in the spool such that a part of the hydraulic fluid is supplied to one of the advance angle chamber and the retardation angle chamber and a part of the hydraulic fluid is supplied to the other chamber through the communication path.

7. The valve timing control apparatus according to claim 6, wherein, when the spool is disposed at the one of the first position and the second position, the phase setting mechanism has a flow path structure in which a flowing amount of a hydraulic fluid which is supplied to the advance angle flow path is caused to be different from a flowing amount of a hydraulic fluid which is supplied to the retardation angle flow path.

8. The valve timing control apparatus according to claim 1, wherein, when the spool is disposed at the one of the first position and the second position, the phase setting mechanism has a flow path allowing a part of a hydraulic fluid to flow out from one of the advance angle flow path and the retardation angle flow path.

9. The valve timing control apparatus according to claim 1, wherein, when the spool is disposed at the one of the first position and the second position, the phase setting mechanism has a flow path structure in which a flowing amount of a hydraulic fluid which is supplied to the advance angle flow path is caused to be different from a flowing amount of a hydraulic fluid which is supplied to the retardation angle flow path.

* * * * *